US005725725A

United States Patent [19]

Salvetti

[11] Patent Number: 5,725,725

[45] Date of Patent: Mar. 10, 1998

[54] AUTOMATIC SOCK LABELING MACHINE

[75] Inventor: Sergio Salvetti, Chiari, Italy

[73] Assignee: Conti Complett S.p.A., Milan, Italy

[21] Appl. No.: 571,787

[22] Filed: Dec. 13, 1995

[30] Foreign Application Priority Data

Dec. 23, 1994 [IT] Italy ..... MI94A2644

[51] Int. Cl.[6] ..... B65C 9/00

[52] U.S. Cl. ..... 156/566; 156/479; 156/570; 156/363

[58] Field of Search ..... 156/566, 541, 156/542, 363, 479, 478, 480, 572, 570

[56] References Cited

U.S. PATENT DOCUMENTS

| | | | |
|---|---|---|---|
| 2,078,448 | 4/1937 | Jost | 156/542 |
| 2,286,458 | 6/1942 | Bowman et al. | 156/542 X |
| 2,501,539 | 3/1950 | Ruth | 156/542 |
| 2,759,283 | 8/1956 | Bowman et al. | 156/542 |
| 3,245,859 | 4/1966 | Busk | 156/479 |
| 3,954,543 | 5/1976 | Messmer | 156/363 |
| 4,004,962 | 1/1977 | Kleid | 156/479 X |
| 4,157,692 | 6/1979 | Brocklehurst . | |
| 4,160,687 | 7/1979 | Spear | 156/479 X |
| 4,327,653 | 5/1982 | Blessing . | |
| 4,505,467 | 3/1985 | Brocklehurst . | |
| 5,228,945 | 7/1993 | Labbé . | |

FOREIGN PATENT DOCUMENTS

| | | |
|---|---|---|
| 62943 | 10/1982 | European Pat. Off. . |
| 2159232 | 6/1973 | Germany . |
| 1223149 | 2/1971 | United Kingdom . |

*Primary Examiner*—James Engel
*Attorney, Agent, or Firm*—Guido Modiano; Albert Josif

[57] ABSTRACT

An automatic sock labeling machine including a conveyor element actuatable with a translatory motion along an advancement direction and extending from a station for loading the socks on the conveyor element to a station for unloading the labeled socks. The path of the conveyor element includes: a station for positioning, in each instance, a label so that it straddles the top of a pair of mutually superimposed socks; a station for fixing the label to the pair of socks; and, if necessary a station for printing markings at the foot of one sock of the pair of socks.

35 Claims, 16 Drawing Sheets

AUTOMATIC SOCK LABELING MACHINE

BACKGROUND OF THE INVENTION

The present invention relates to an automatic sock labeling machine, particularly for automatically labeling long or knee socks or short socks.

Long knee socks or short socks are conventionally labeled at the end of the sock production cycle before packaging them. This operation consists in applying a label astride the top of a pair of mutually superimposed socks, and in providing, on the lower part of the foot of a sock, a print that generally indicates the trademark of the manufacturer, the size, or other information.

Socks are currently labeled with a process that is largely manual, since an operator manually places the label astride the pair of socks in the top region and then fixes the label to the socks by means of a stapling machine.

The printing operation is also performed substantially fully manually, by thermal transfer of the print, provided as a decal on a supporting ribbon, from the supporting ribbon to the foot of one of the socks.

The labeling operation therefore requires the use of a relatively large number of operators and significantly affects the overall production costs of the socks.

SUMMARY OF THE INVENTION

A principal aim of the present invention is to solve the above problem by providing a machine that can label socks in a fully automatic manner, allowing a considerable saving with respect to the costs related to this operation.

An object of the invention is to provide a machine that is capable of labeling both long knee socks and short socks.

Another object of the invention is to provide a machine that can apply the label in the top region of the socks and the print on the foot of a sock with high precision.

Another object of the invention is to provide a machine that is highly reliable in operation.

In accordance with the invention, there is provided an automatic sock labeling machine, particularly for labeling long or knee socks or short socks, which includes a conveyor element that can be actuated with a translatory motion along an advancement direction and extends from a station for loading the socks on the conveyor element to a station for unloading the labeled socks. The path of the conveyor element includes a station for positioning, in each instance, a label astride the top of a pair of socks, and a station for fixing the label to the pair of socks.

Advantageously, a station for printing markings at the foot of one sock of the pair of socks is located downstream of the fixing station along the advancement direction of the conveyor element.

BRIEF DESCRIPTION OF THE DRAWINGS

The characteristics and advantages of the invention will become apparent from the following detailed description of some preferred but not exclusive embodiments thereof, illustrated in the accompanying drawings and described herein only by way of non-limitative example, wherein.

DESCRIPTION OF THE PREFERRED EMBODIMENTS

Figure 1:
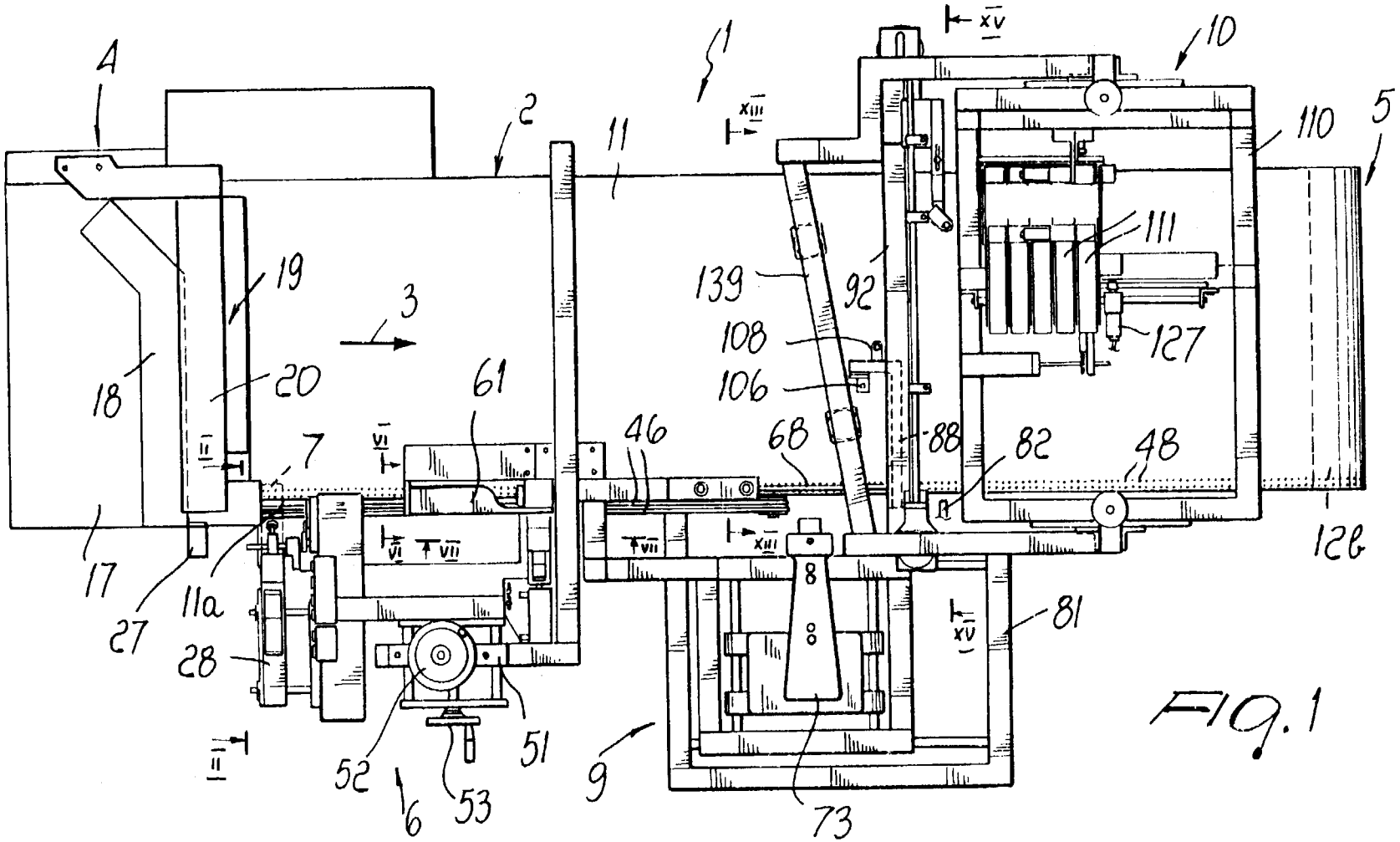
FIG. 1 is a schematic top plan view of one preferred embodiment of a machine according to the present invention.

With reference to the above figures, a preferred embodiment of an automatic sock labeling machine according to the invention, generally designated by the reference numeral 1, comprises a conveyor element 2 actuatable with a translatory motion along an advancement direction, indicated by the arrow 3 in FIG. 1, and extending or running from a loading station 4, in which the socks to be labeled, grouped in pairs composed of two mutually superimposed socks each, are arranged on the conveyor element 2, to an unloading station 5, in which the labeled socks leave the conveyor element 2. The path of the conveyor element 2 includes: a positioning station 6, in which in each instance a label 7 is positioned astride the top of a pair of socks 8; a station 9 for fixing the label 7 to the pair of socks 8; and a printing station 10, where indications as to the size, manufacturer trademark, and other indications are printed on the foot of one of the socks that compose a pair of socks.

More particularly, the conveyor element 2 comprises a belt 11 that winds around two rollers 12*a* and 12*b* that are arranged so that their axes lie horizontally and parallel to each other.

The rollers 12*a* and 12*b* are arranged so that the upper portion of the belt 11, which runs between the two rollers 12*a* and 12*b*, is arranged on a substantially horizontal plane. Such upper portion of the belt 11 rests, for at least one part of its extension, on a substantially horizontal supporting surface 13 and forms, with its upper face, a substantially horizontal supporting surface for the socks 8.

The belt 11 can be constituted, as shown in the accompanying drawings, by a ribbon of synthetic material of adequate width, with two toothed belts 14 fixed on its inner face, i.e., on the face that winds around the rollers 12*a* and 12*b*; the belts 14 engage toothed regions correspondingly provided on the rollers 12*a* and 12*b*.

The roller 12*a* is driven, by means of a chain 16, so that it rotates about its own axis by a gearmotor-variator unit 15.

The loading station 4 is composed of a fixed table 17 that is substantially horizontal, faces the initial end of the belt 11, and forms a substantially horizontal surface for supporting the pairs of socks 8 to be labeled.

The fixed table 17 conveniently has, proximate to its end directed towards the belt 11, a positioning region 18 on which a pair of socks 8 is arranged, in each instance; in the case of long or knee socks, the pair is prepared so that the foot is folded above the lower portion of the leg and so the top is arranged proximate to a longitudinal edge 11*a* of the belt 11, whereas in the case of short socks, said socks are simply arranged so that the top lies at the longitudinal edge 11*a* of the belt 11 and the foot is not folded.

Above the fixed table 17 there are feeder means 19 that are movable along the advancement direction 3 on command in a reciprocating manner and can engage on command the pair of socks 8 that is waiting on the positioning region 18 of the fixed table 17, so as to make the pair pass onto the belt 11 such that the top of the socks is arranged proximate to the longitudinal edge 11*a* of the belt.

Figure 5:
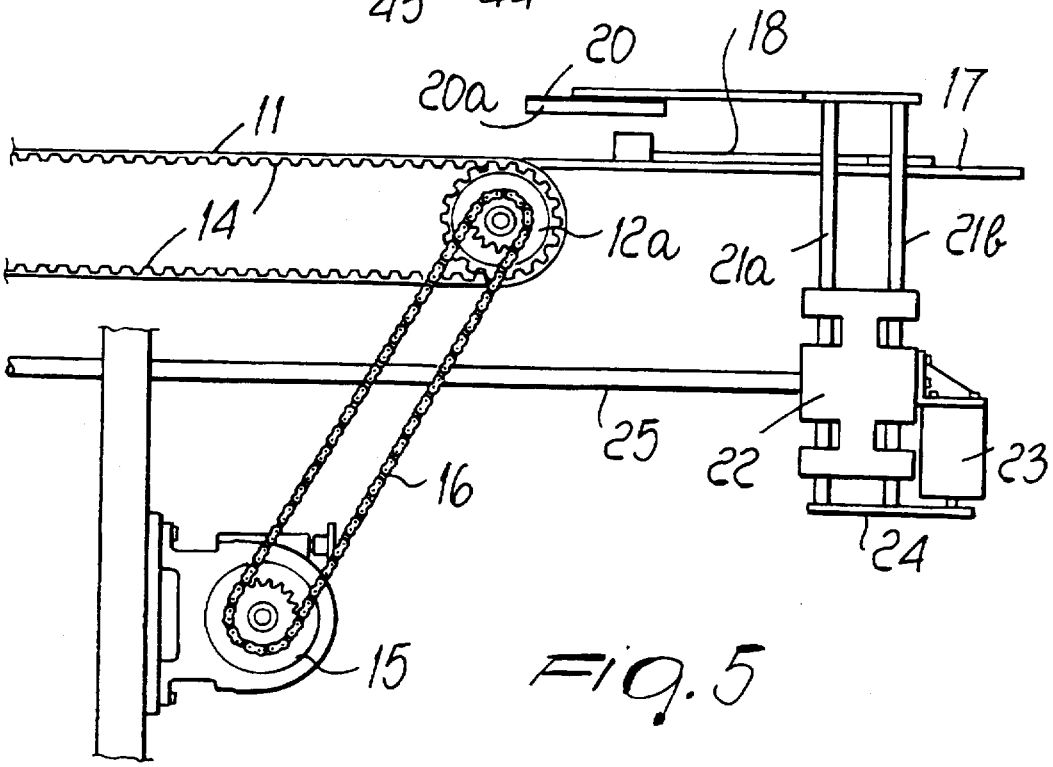
FIG. 5 is a schematic rear elevation view of the loading station.

The feeder means 19, as shown in particular in FIG. 5, comprise a plate 20 that faces the fixed table 17 in an upward region and is conveniently covered, on its lower side, with a layer 20*a* of high-grip material, such as for example sponge. The plate 20 is fixed to two vertical guides 21*a* and 21*b* that are slideably supported by a block 22 so as to be slideable along their axes with respect to the block. A fluid-actuated cylinder 23 is fixed to the block 22 and acts, by means of the stem of its piston, on a cross-member 24 that is fixed to the lower end of the vertical guides 21*a* and 21*b* and which, when it is actuated, causes the lowering or the lifting of the plate 20 towards the fixed table 17.

The block 22, which supports the plate 20 by means of the vertical guides 21*a* and 21*b*, is connected, by a bar 25, to a movable structure 26 which will be described in greater detail hereinafter and causes the alternating movement of the plate 20 parallel to the advancement direction 3.

In order to facilitate the positioning of the top of the socks 8, in the correct position, an abutment 27 is provided laterally to the fixed table 17 such that the top of the socks 8 may be correctly arranged against the abutment.

The positioning station 6 comprises a magazine 28, for containing a plurality of labels 7, and means for sequentially removing one of the labels 7 from the magazine 28 to deposit it on the longitudinal edge 11*a* of the belt 11 so that a portion of the label 7 protrudes from the longitudinal edge 11*a* of the belt. Means for retaining the label on the belt 11, after depositing it, are also provided at the positioning station 6.

Figure 2:
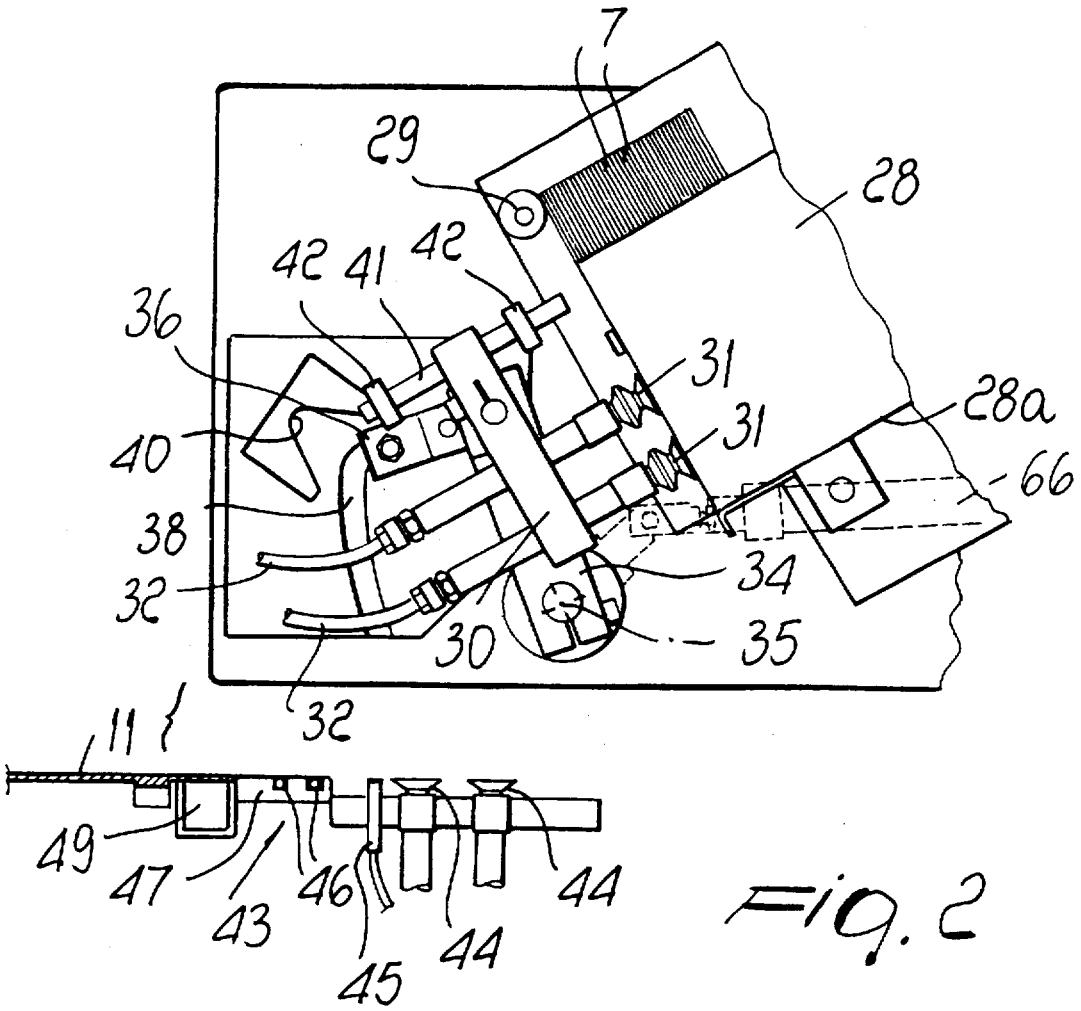
FIG. 2 is a schematic and enlarged-scale sectional view of a detail of FIG. 1, taken along the plane II—II and illustrating label removal means located in the positioning station.
Figure 3:
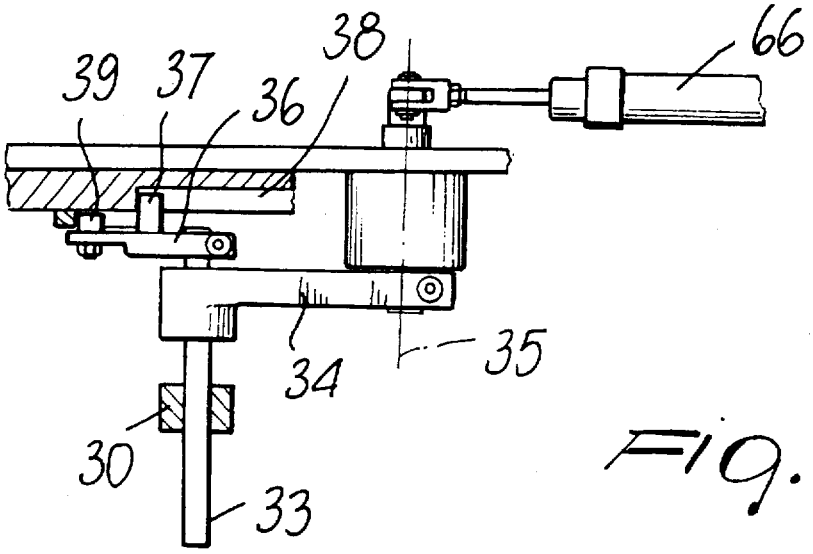
FIG. 3 is a schematic and partially sectional plan view of FIG. 2, with some elements removed for greater clarity.
Figure 4:
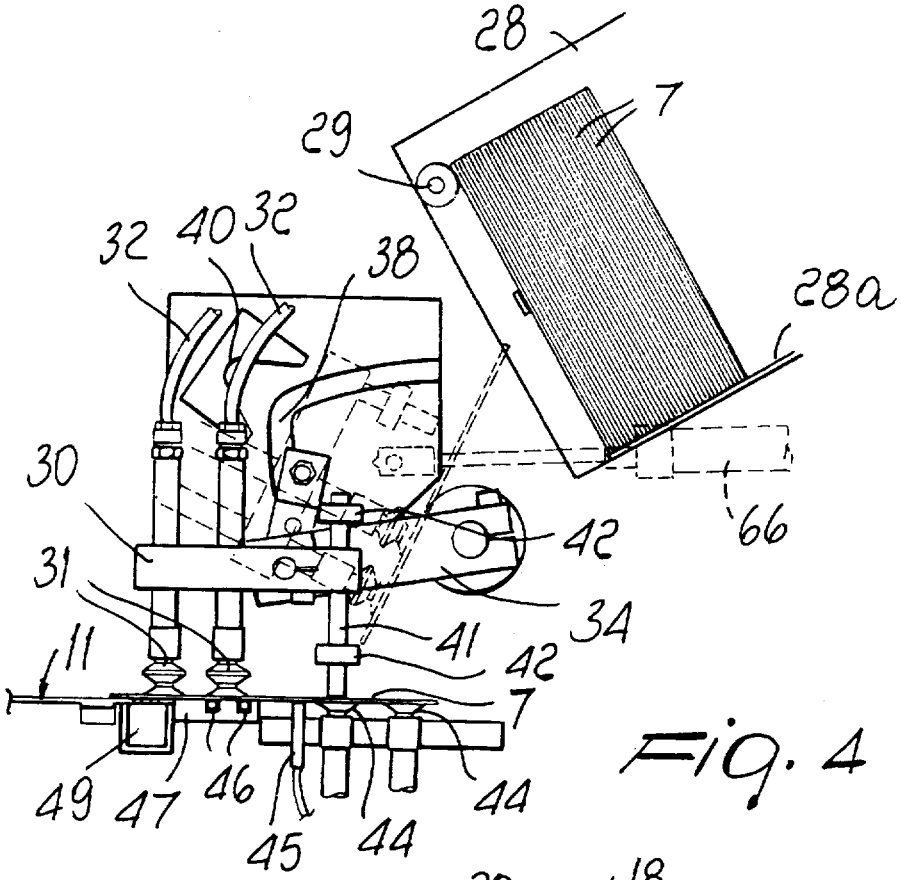
FIG. 4 is a schematic and enlarged-scale sectional view, taken like FIG. 2, illustrating the deposition of a label on the conveyor element.

More particularly, as shown in particular in FIGS. 2 to 4, the magazine 28 is open at the top, so as to allow the insertion of the labels 7 that are stacked together and rested on a bottom 28*a* of the magazine that is tilted towards the belt 11.

The end of the magazine 28 that is directed towards the belt 11 is open, and at such end there is a supporting pin 29, against which the upper end of the stack of labels 7 rests.

The label removal means include a movable arm 30, to which a pair of suckers 31 is fixed; by means of ducts 32, the suckers can be connected on command to conventional suction means that are not shown for the sake of simplicity.

More particularly, the movable arm 30 is fixed to the end of a shaft 33 keyed to the end of a crank 34 which is actuated with an oscillating motion about a horizontal axis 35 by means of a fluid-actuated cylinder 66.

The shaft 33 is rotatably supported by the crank 34 about its own axis, and its end that lies opposite to the movable arm 30 with respect to the crank 34 is connected to a block 36 that engages a long pivot 37 inside a cam-shaped slot 38. The block 36 is also provided with a short pivot 39 that can engage a V-shaped recess 40 when the long pivot 37 reaches an intermediate position inside the cam-shaped slot 38; by means of the recess 40, the arm 30 undergoes a partial oscillation such that the suckers 31 are arranged on a substantially horizontal plane and face the plane of arrangement of the belt 11. The actuation of the fluid-actuated cylinder 66 causes the oscillation of the movable arm 30 about the axis 35 and therefore the passage of the suckers 31 from an engagement position, in which they face the first label 7 of the stack inside the magazine 28, to a release position, in which the suckers 31, with the label 7 taken from the magazine 28, face the plane of arrangement of the belt 11. In the release position, the label 7 partly rests against the upper face of the belt 11 and partly protrudes laterally from the longitudinal edge 11*a* of the belt 11.

Auxiliary supporting means, generally designated by the reference numeral 43, for supporting the portion of the label 7 that protrudes laterally from the longitudinal edge 11*a* of the belt, are provided laterally to the longitudinal edge 11*a*.

The movable arm 30 is also provided with a presser 41 with counterweights 42 that is slideably supported transversely to the movable arm 30 and acts by gravity on the portion of the label 7 that protrudes laterally from the longitudinal edge 11*a* when the label is placed on the belt 11.

A pair of suckers 44 is provided laterally to the auxiliary supporting means 43, at the region where the label 7 is released; the suckers 44 can be connected on command to conventional suction means, which are not illustrated for the sake of simplicity, and engage the lower face of the end of the portion of the label 7 that protrudes from the longitudinal edge 11*a* of the belt to facilitate its release by the suckers 31. The presser 41 acts exactly at the region of the label that is affected by the suckers 44, so as to facilitate the engagement of the label by the suckers 44.

A sensor 45 is also provided proximate to the suckers 44, which detects the correct release of the label 7 on the part of the suckers 31.

Figure 6:
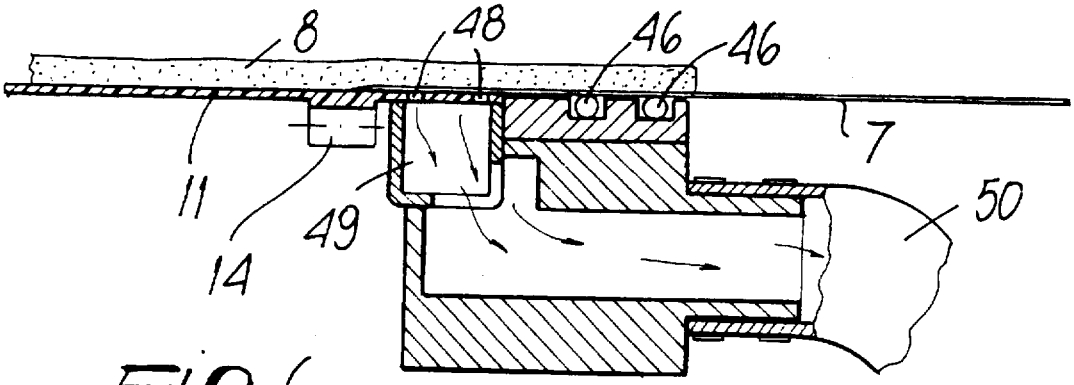
FIG. 6 is a schematic and enlarged-scale sectional view, taken along the plane VI—VI, of a detail of FIG. 1.

The auxiliary supporting means 43, as shown in particular in FIG. 6, comprise two secondary belts 46 arranged parallel to the edge 11*a* of the belt 11 and supported by a block 47. The secondary belts 46 are actuated with a translatory motion along the advancement direction 3 at the same advancement rate given to the belt 11.

The belt 11 has, at the longitudinal edge 11*a*, a plurality of perforations 48 which are subjected to suction at the positioning station 6 so as to retain the label 7 on the belt 11 after it has been released by the suckers 31.

A channel 49 is arranged at the positioning station 6, below the longitudinal edge 11*a* of the belt 11, i.e., at the perforations 48; the channel 49 is open at the top, i.e., on its side resting against the portion of the belt 11 that is provided with the perforations 48, and can be connected on command, by means of a duct 50, to conventional suction means not shown for the sake of simplicity.

The magazine 28 and the means for removing the labels from the magazine 28 are mounted on a structure 51 which, by means of handwheels 52 and 53, can be adjusted in height and in a direction that lies transversely to the advancement direction 3, so as to obtain the correct positioning of the label 7 on the longitudinal edge 11*a* of the belt 11.

Downstream of the means for removing the labels from the magazine 28, along the advancement direction of the belt 11 along the direction 3, there are means for folding the portion of the label that protrudes from the longitudinal edge 11*a* of the belt 11 and from the auxiliary supporting means 43, so as to move this portion of the label above the region of the pair of socks, proximate to its top, which rests on the label portion resting on the belt 11.

The folding means, as shown in particular in FIGS. 9 and 10, comprise a roller 54 which is movable on command from an inactive position, where it is located below the plane of arrangement of the belt 11 and is spaced laterally therefrom, to an active position, where the roller 54 is located above the plane of arrangement of the belt 11 and is moved transversely to the belt 11 towards the belt with respect to the inactive position.

More particularly, the roller 54, the axis whereof lies horizontally and parallel to the longitudinal edge 11*a* of the belt 11, is supported, so as to be rotatable about its own axis, at a longitudinal end of an arm 55 lying transversely to the advancement direction 3.

The arm 55 is mounted on a substantially horizontal supporting plate 56 that is connected to the end of the stem of the piston of a double-action fluid-actuated cylinder 57, through which it is possible to raise or lower the supporting plate 56 and therefore the arm 55.

Another double-action fluid-actuated cylinder 58 is also mounted on the plate 56 and is connected directly to the arm 55 with the end of the stem of its piston. The fluid-actuated cylinder 58 is arranged so that its axis lies transversely to the advancement direction 3, so as to move the arm 55, and therefore the roller 54, transversely to the advancement direction 3.

The arm 55 is articulated to the supporting plate 56 by means of the fluid-actuated cylinder 58 and rests, by means of a cam-follower roller 59, on a cam-shaped raised portion 60 provided on the upper face of the supporting plate 56, so that in its advancement towards the belt 11, by actuating the fluid-actuated cylinder 58, it is lowered proximate to the end of its advancement stroke. Such lowering causes a pressing of the portion of the label 7 that is folded above the pair of socks 8 onto the socks themselves.

The supporting plate 56 is connected to the movable structure 26 which, as mentioned, can be actuated with a reciprocating motion along the advancement direction 3 and is rigidly coupled to the belt 11 in its advancement motion, so that during the folding of the label 7 the folding means move rigidly with the belt 11.

Figure 7:
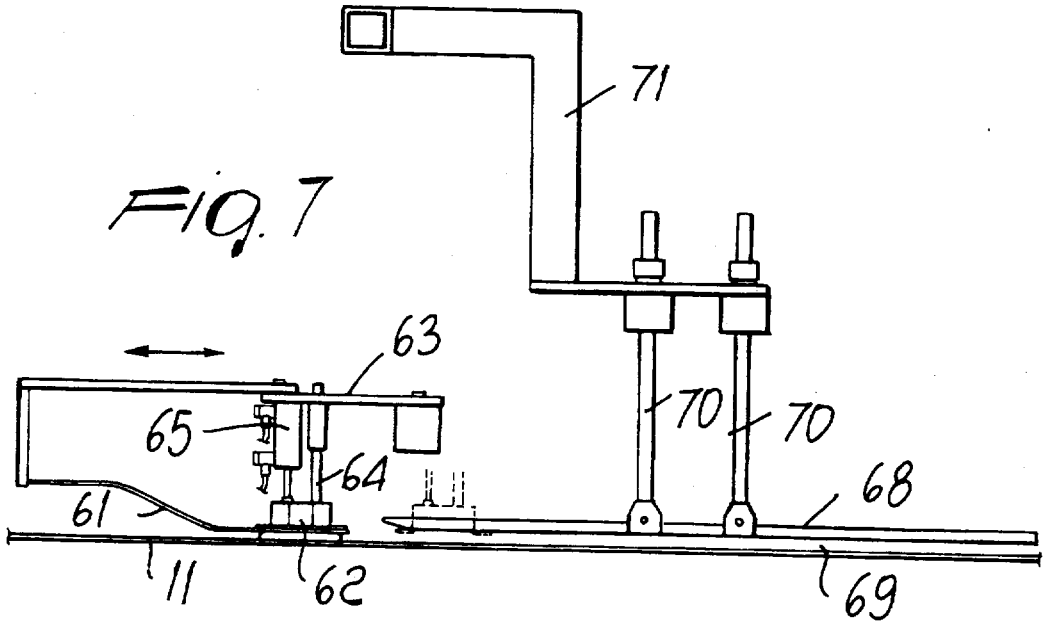
FIG. 7 is a schematic and enlarged-scale view, taken along the plane VII—VII, of another detail of FIG. 1.

Means for pressing the top region of the pair of socks on the auxiliary supporting means 43 are interposed between the means for removing the label 7 from the magazine 28 and the folding means. The pressing means, as shown in particular in FIGS. 7 to 9, include a flexible lamina 61 that faces the belt 11 in an upward region and forms, in cooperation with the belt 11, a passage for the portion of the socks that rests on the label and for the underlying portion of the label. The distance between the lamina 61 and the belt 11 decreases gradually along the advancement direction of the belt along the direction 3, so that the socks are gradually pressed by passing below the lamina 61. The end 61*a* of the lamina 61 that is orientated opposite to the region for the deposition of the label 7 on the belt 11 has a reduced width, and a presser element 62 is provided at such end 61*a*. The presser element 62 is aligned with the roller 54 along a direction that lies transversely to the advancement direction 3 and is supported by a supporting plate 63 so as to be slideable along a vertical direction.

More particularly, the presser element 62 is fixed to the lower end of a guiding bar 64 arranged vertically and supported by the supporting plate 63 so as to be slideable along its own axis. The presser element 62 is also fixed to the end of the stem of the piston of a double-action fluid-actuated cylinder 65 that is also fixed to the supporting plate 63 and arranged vertically. The actuation of the fluid-actuated cylinder 65 causes the lifting or lowering of the presser element 62, so as to move the presser element 62 that presses the underlying pair of socks 8 on the belt 11.

Figure 8:
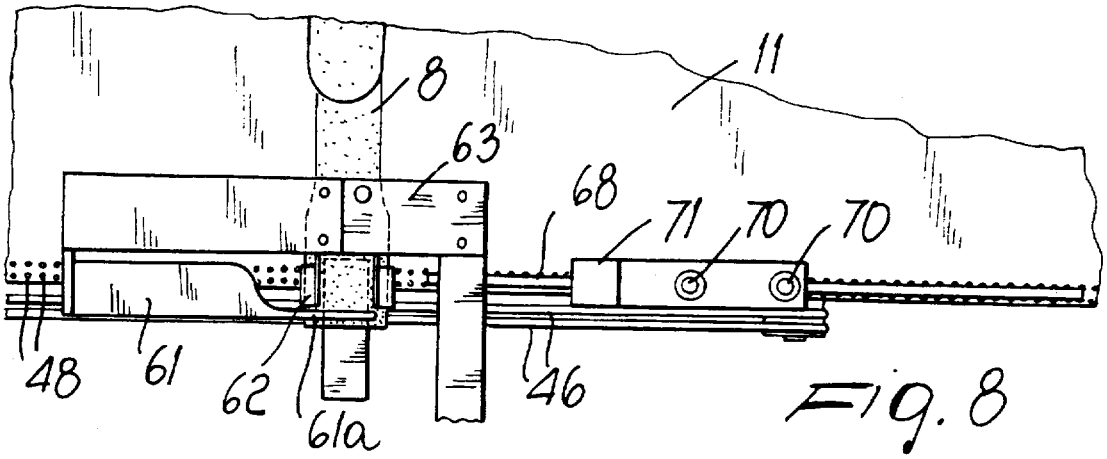
FIG. 8 is a top plan view of the same detail of FIG. 7.
Figure 9:
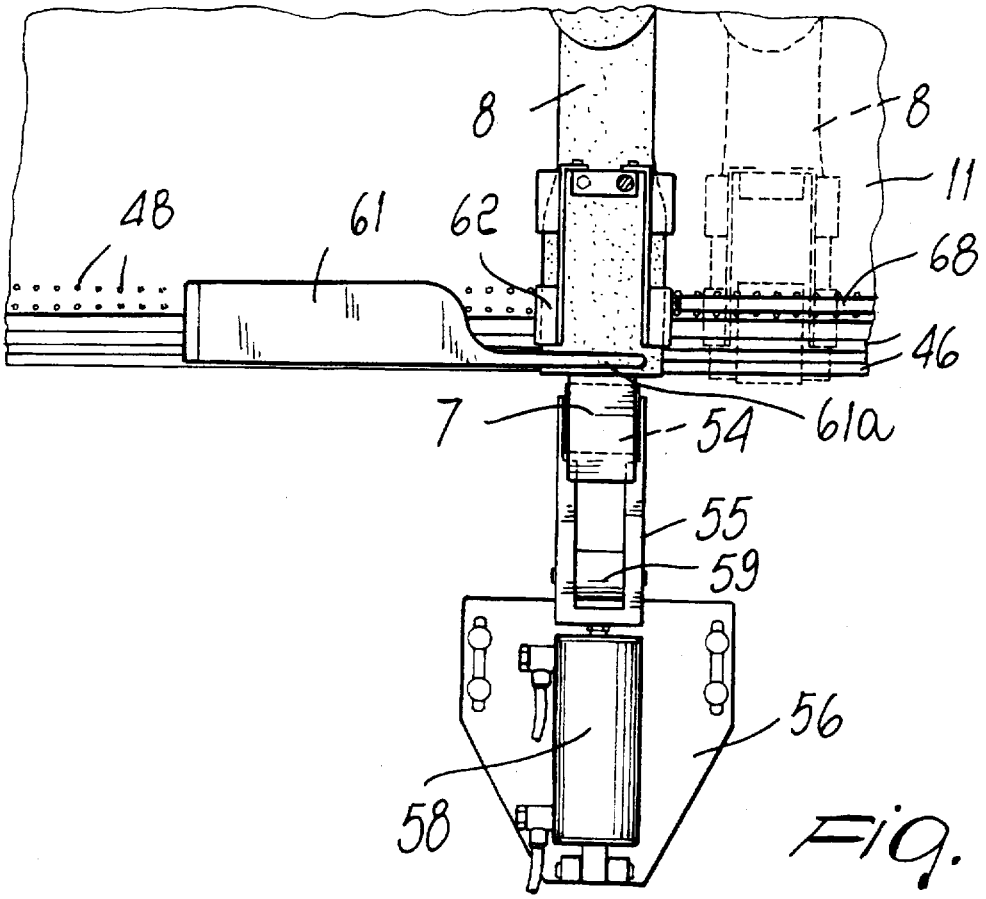
FIG. 9 is a further-enlarged top plan view of the same detail of FIGS. 7 and 8, illustrating means for folding the label astride the top of a pair of socks.
Figure 10:
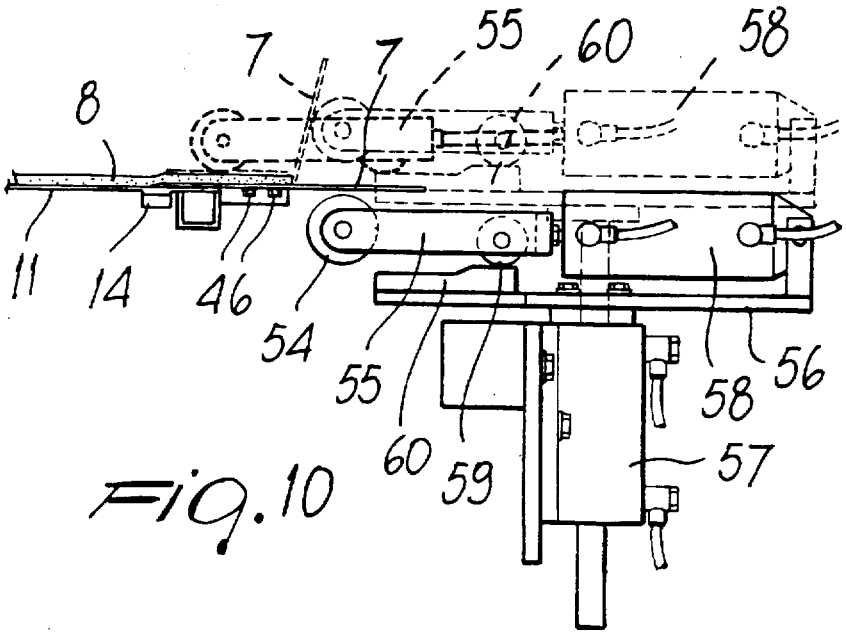
FIG. 10 is a schematic side elevation view of the label folding means.

The presser element 62 is shaped so as to press the two regions of the pair of socks 8 located laterally to the region adapted to receive the portion of the label 7 that is folded by the roller 54, as shown in particular in FIGS. 8 and 9, so as not to interfere with the folding operation performed by the roller 54. The lamina 61 and the presser element 62, as well as the supporting plate 63, are also connected to the movable structure 26 so that during the folding of the portion of the label 7 above the top region of the pair of socks, these elements move rigidly with the belt 11 along the advancement direction 3.

Means for keeping the fold given to the label 7 are interposed between the label folding means and the fixing station 9, which is arranged downstream of the positioning station 6 along the advancement direction of the belt 11. The fold keeping means, as shown in particular in FIGS. 7, 8, 9, and 11, comprise a guide 68 that faces the belt 11 in an upward region and forms, in cooperation with the belt 11, a passage 69 for the region of the pair of socks affected by the label 7. The guide 68 is supported by two vertical bars 70 in turn supported by a frame 71.

Figure 11:
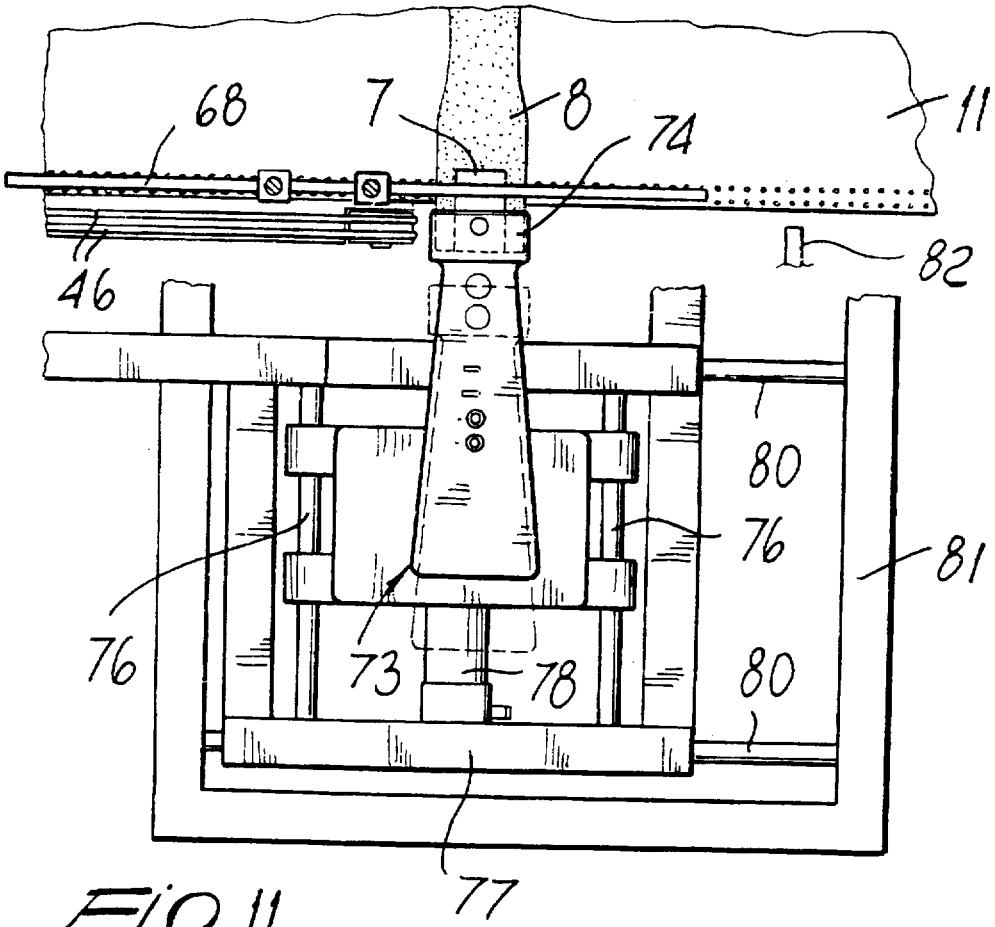
FIG. 11 is a schematic top plan view of the label fixing station.
Figure 12:
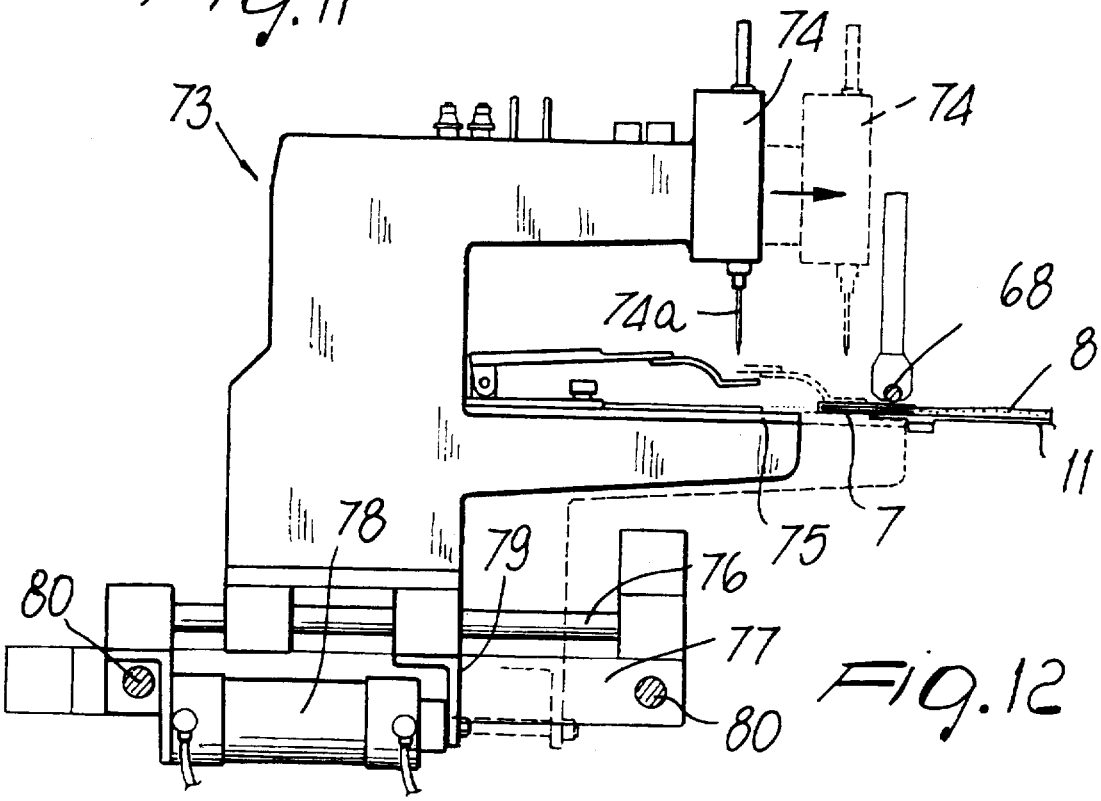
FIG. 12 is a schematic lateral elevation view of the label fixing station.

The sewing station 9, as shown in particular in FIG. 11 and 12, comprises a conventional sewing machine 73 provided with a sewing head 74 with a needle 74*a* that faces a base plate 75, in which the other elements for forming the stitches are contained.

The sewing machine 73 is arranged laterally adjacent to the longitudinal edge 11*a* of the belt 11 and is movable on command along a direction that lies transversely to the direction 3 so as to engage, with its sewing head 74, the portion of the label 7 that is folded so as to straddle the top of the socks, which protrudes laterally from the longitudinal edge of the belt 11, the auxiliary supporting means 43 being no longer present directly upstream of the sewing station 9.

More particularly, the sewing machine 73 is supported by a footing 77 by means of two horizontal bars 76.

The horizontal bars 76 are orientated transversely to the advancement direction 3, and the footing 77 supports a double-action fluid-actuated cylinder 78, in which the stem of the piston acts on an L-shaped element 79 that is fixed to the sewing machine 73, so as to move the sewing machine 73 transversely to the advancement direction 3, so as to engage or disengage its sewing head 74 with or from the portion of the label 7 that straddles the socks.

The footing 77 is in turn slideably installed along two horizontal bars 80 that run parallel to the advancement direction 3 and are supported by a fixed frame 81. The footing 77 is also connected to the movable structure 26, so that the sewing machine 73 moves rigidly with the belt 11 during sewing.

Directly downstream of the sewing station 9 means are provided for detecting whether the label has been fixed to the pair of socks.

Said detection means can be simply constituted by a photocell 82 arranged laterally adjacent to the longitudinal edge 11*a* of the belt 11 and facing the belt 11 directly above its upper face, after the end of the guide 68, so as to abut against the portion of a label 7 that possibly has not been sewn and would rise above the pair of socks in case the guide 68 were not present. The photocell 82 can be connected to an actuation and control element that supervises the operation of the machine to stop the operation of the machine or to provide for the intervention of optional selector means that would discard the pair of socks 8 at the exit of the unloading station 5.

Means for gripping and causing the translatory motion of the pair of socks, after fixing the label 7, along a direction that lies transversely to the advancement direction 3 of the belt 11 are interposed between the fixing station 9 and the printing station 10, which is arranged downstream of the fixing station 9 along the advancement direction of the belt 11 along the direction 3.

Figure 15:
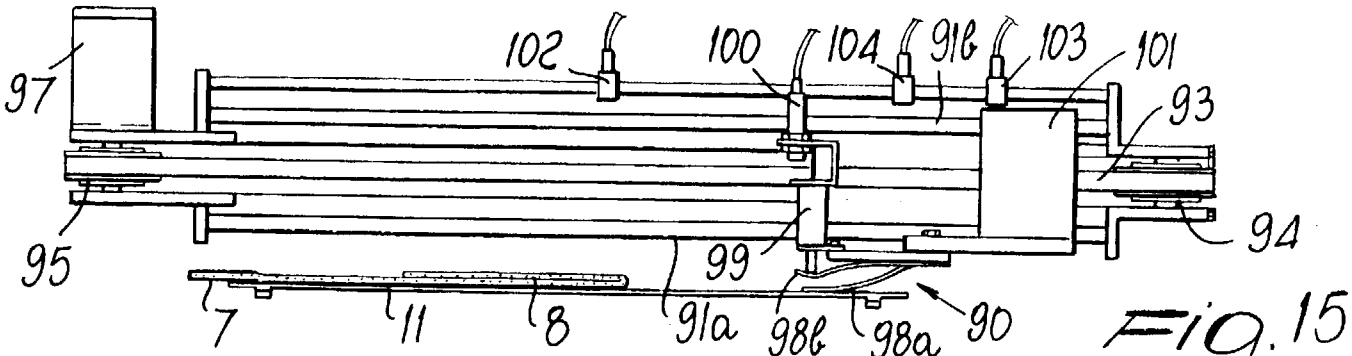
FIG. 15 is a schematic and enlarged-scale sectional view of FIG. 1, taken along the plane XV—XV.
Figure 16:
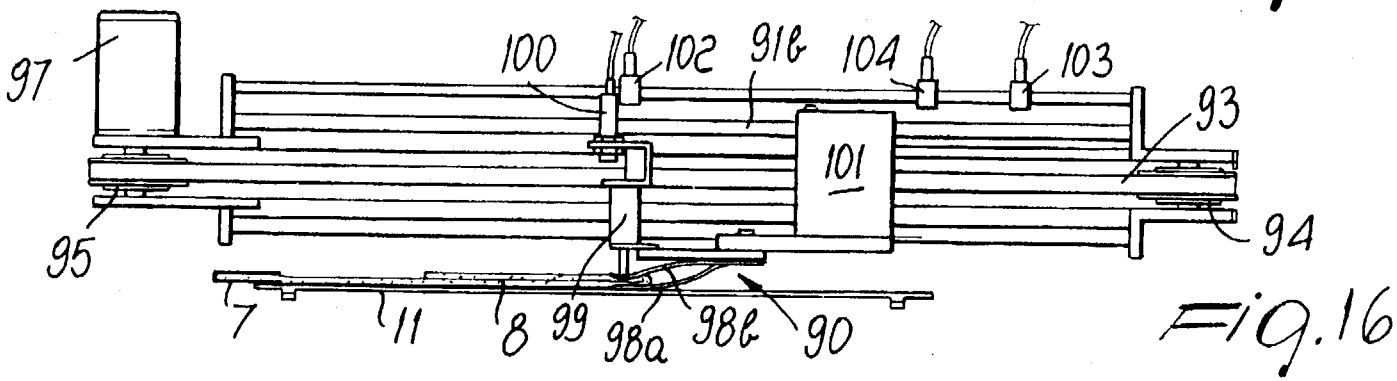
FIGS. 16 and 17 are schematic sectional views, taken like FIG. 15, illustrating the operation of the elements shown in such figure.
Figure 17:
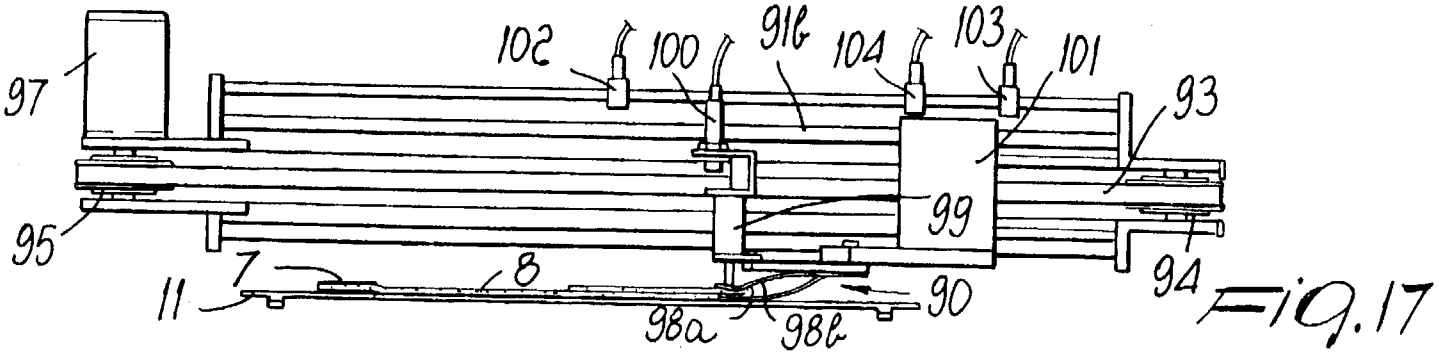

Said grip and translatory motion means, as shown in particular in FIGS. 15 to 17, comprise a clamp 90 that is slideably mounted along a pair of horizontal guides 91*a* and 91*b* running transversely to the advancement direction 3. The horizontal guides 91*a* and 91*b* are fixed to a cross-member 92 of the movable structure 26, and the clamp 90 is connected to a toothed belt 93 running or extending parallel to the guides 91*a* and 91*b* and winding around a pair of pulleys 94 and 95; said pulleys, too, are rotatably supported by the movable structure 26 about their respective axes. The pulley 95 is driven by a step motor 97 that causes the reciprocating translatory motion of the clamp 90 along the guides 91*a* and 91*b*.

The clamp 90 is composed of a fixed jaw 98*a* and of a movable jaw 98*b*, on which the stem of a piston of a fluid-actuated cylinder 99 acts; the piston is also supported by the guides 91*a* and 91*b*, and its actuation moves the movable jaw 98*b* towards or away from the fixed jaw 98*a*, i.e., it closes or opens the clamp 90.

Proximate to the open end of the clamp 90 there is a photocell 100 or an equivalent detector element adapted to detect the engagement of the clamp 90 with a pair of socks 8, thus giving the clearance signal for the closure of the clamp to grip the pair of socks 8.

Above the clamp 90, i.e, above the block 101 that supports it and that is slideable along the horizontal guides 91*a* and 91*b*, two proximity sensors 102 and 103 are provided for detecting when the clamp 90 reaches the two extreme operating positions transversely to the direction 3, as well as an intermediate proximity sensor 104 that detects when the clamp 90, after gripping the pair of socks 8, reaches the preset point on the belt 11, whereat the clamp 90 is actuated so as to release the pair of socks 8.

Proximate to the cross-member 92, upstream of the grip and translatory motion means along the advancement direction of the belt 11, there are also means for orientating the foot of the pair of socks along an axis that is substantially perpendicular to the advancement direction 3, if the socks fed to the machine are short and if, as mentioned, they have been fed so that the foot rests on the belt 11, i.e., so that the extension of the foot is inclined at an angle with respect to the advancement direction 3.

Figure 18:
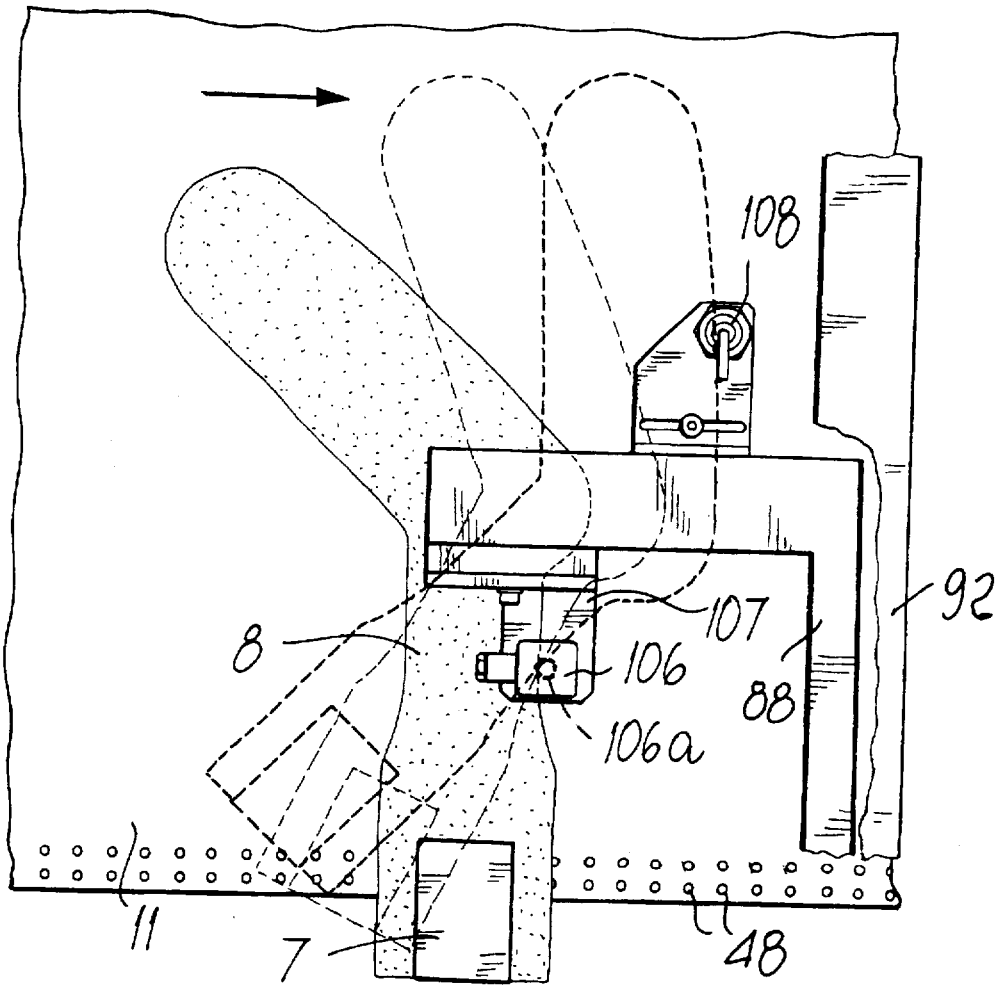
FIG. 18 is an enlarged-scale view of a detail of FIG. 1.
Figure 19:
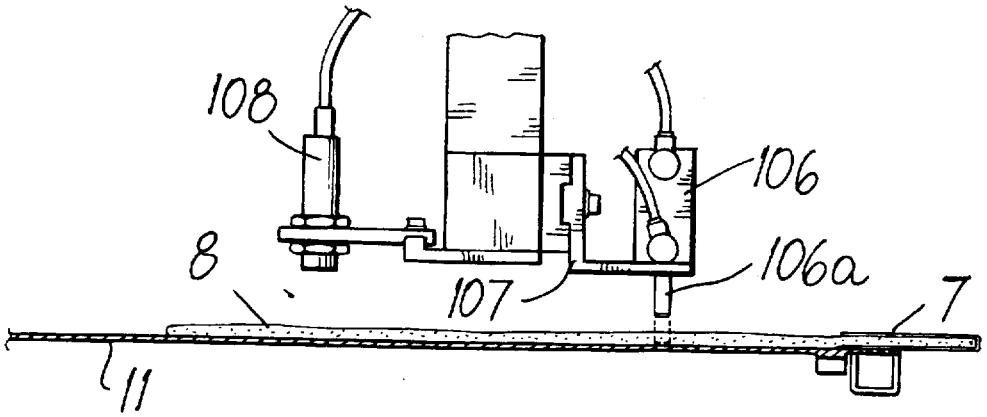
FIG. 19 is a side elevation view of the same detail of FIG. 18.

Said orientation means, as shown in particular in FIGS. 18 and 19, comprise a double-action fluid-actuated cylinder 106 supported by an L-shaped element 107 that is fixed to an arm 88 arranged above the belt 11, rigidly coupled to the fixed structure of the machine, and orientated so that its axis lies vertically. The stem 106*a* of the piston of the fluid-actuated cylinder 106 can be moved, by actuating the fluid-actuated cylinder 106, from an inactive position, in which it is spaced upwardly from the belt 11, to an active position, in which it is substantially in contact with the upper face of the belt 11, so as to form a stop element, against which the region of the pair of socks that lies directly above the heel during the advancement of the belt 11 engages. As a consequence of the contact of the pair of socks with the stem 106*a* of the fluid-actuated cylinder 106, in combination with the advancement motion of the belt 11, a rotation of the pair of socks occurs about the stem 106*a*, thus varying the inclination of the extension of foot of the pair of socks with respect to the advancement direction 3. A detector element, for example a photocell 108, is also fixed to the arm 88 and is arranged so as to detect when the foot of the pair of socks 8 reaches the correct position with an orientation that lies substantially at right angles to the advancement direction 3. The photocell 108 is operatively connected to the fluid-actuated cylinder 106 so as to cause the stem 106*a* to pass from the active position to the inactive position as soon as the foot of the pair of socks reaches the correct position, i.e., is orientated along an axis that is substantially at right angles to the advancement direction 3.

Figure 23:
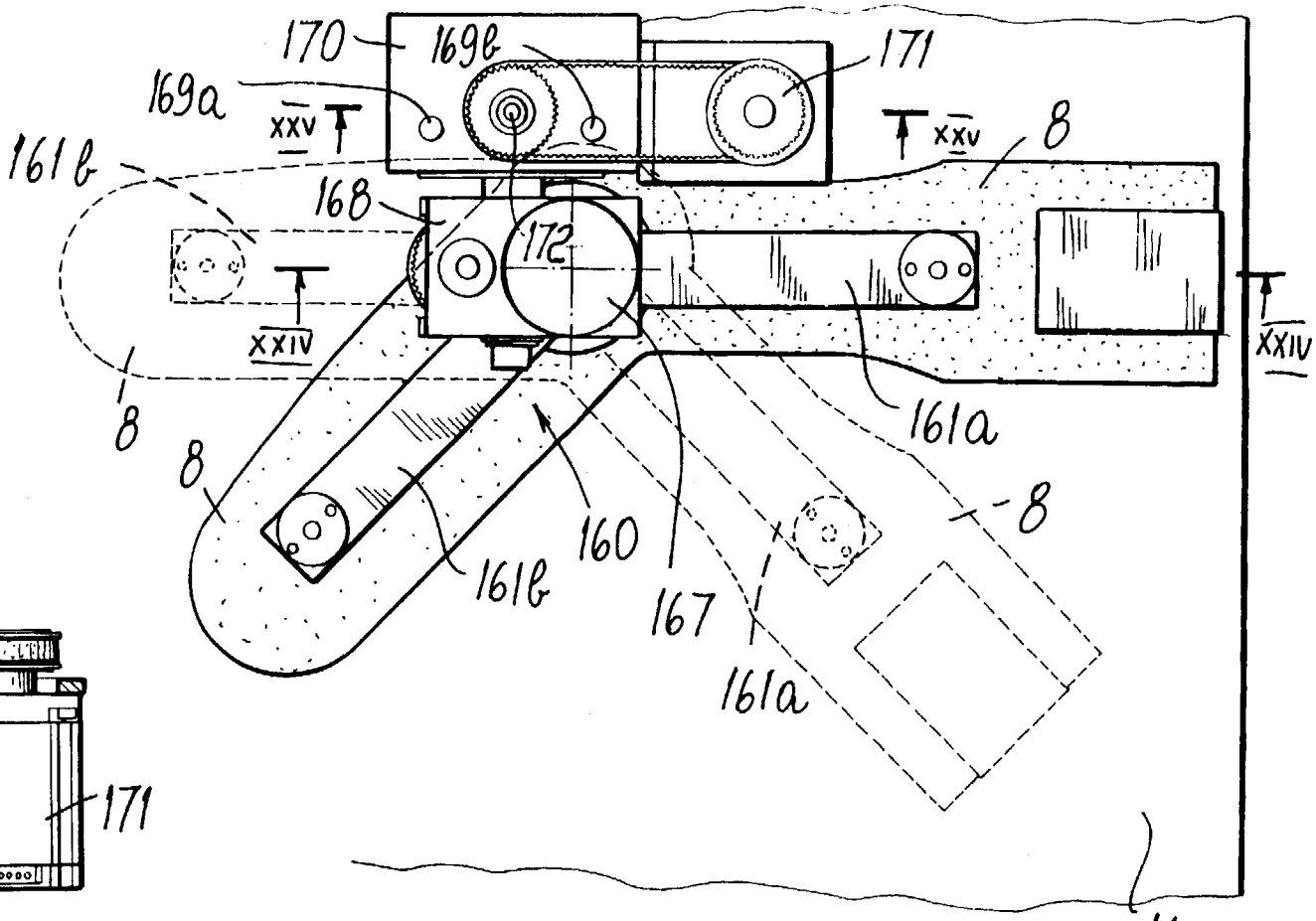
FIG. 23 is a top plan view of a different embodiment of the detail shown in FIGS. 18 and 19.
Figure 25:
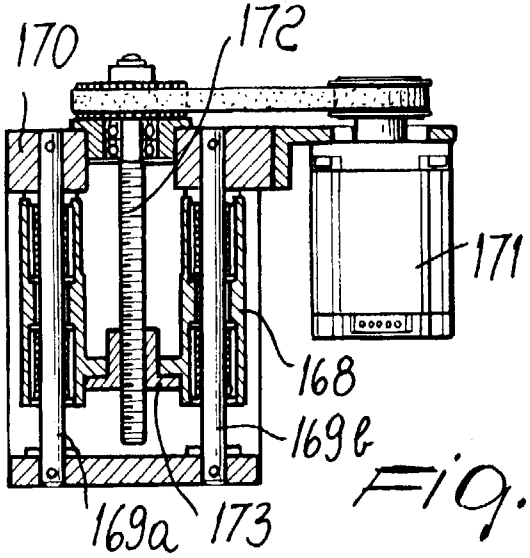
FIG. 25 is a sectional view of FIG. 23, taken along the plane XXV—XXV.
Figure 24:
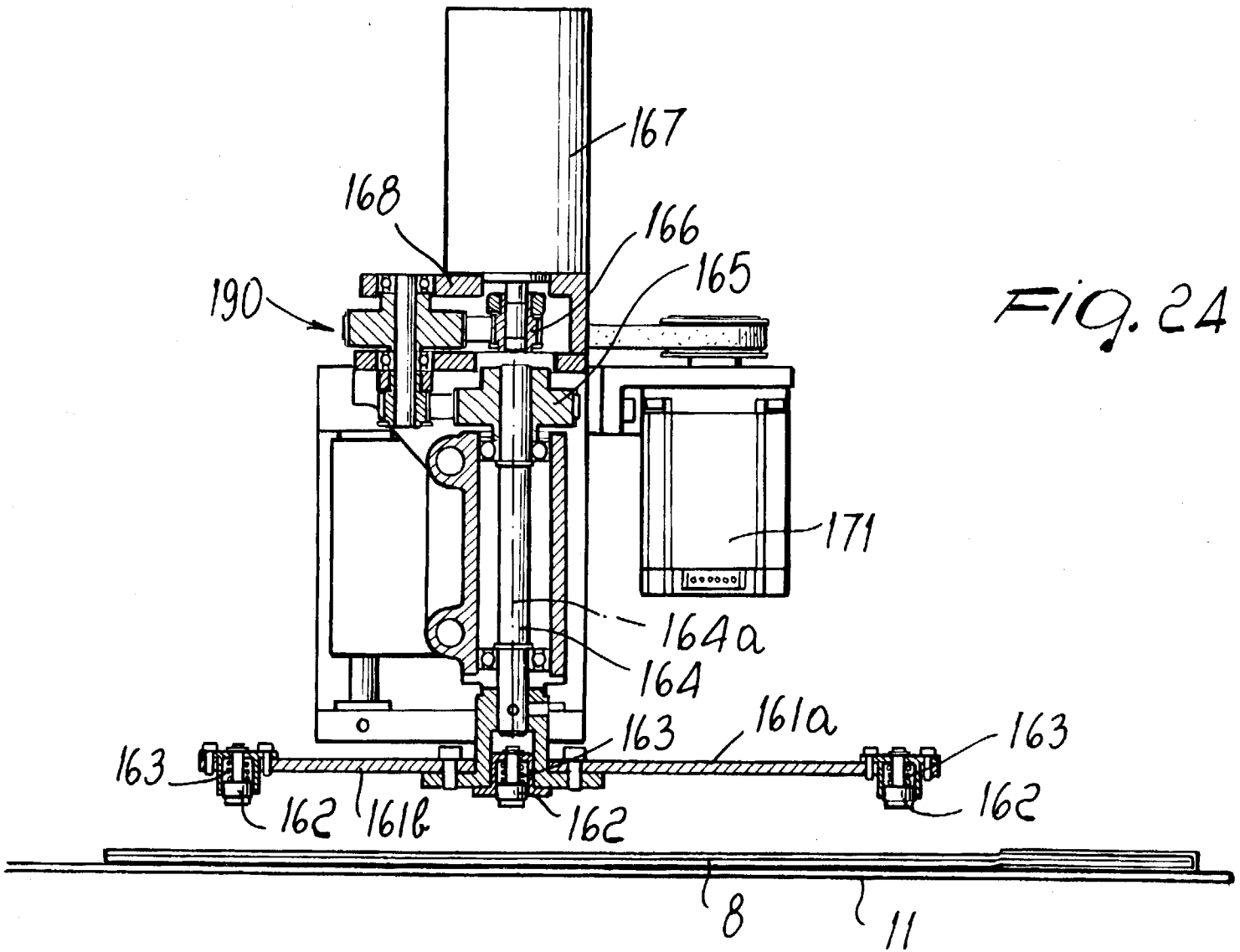
FIG. 24 is a sectional view of FIG. 23, taken along the plane XXIV—XXIV.

As shown in FIGS. 23 to 25, the means for orientating the foot of the pair of socks can be constituted, as an alternative, by an orientation element 160 that faces, in an upward region, the surface formed by the belt 11 and includes two arms 161*a* and 161*b* that lie on a plane that is substantially parallel to the belt 11 and are inclined with respect to each other so as to match the angle that is usually present between the foot extension and the leg extension of a sock. The two arms 161*a* and 161*b* have, proximate to their ends and to the connecting region, feet 162 that protrude downward and on which damping springs 163 act.

The two arms 161*a* and 161*b* are fixed, at the connecting region, to the lower end of a shaft 164, whose axis 164*a* is substantially perpendicular to the belt 11, i.e., vertical. A toothed pulley 165 is keyed to the shaft 164, and a belt meshes with such pulley; by means of the belt, the shaft 164 is connected, through a reduction unit 190, to a toothed pulley 166 keyed to the output shaft of an electric motor 167, for example a step motor, by means of which it is possible to cause the rotation of the shaft 164 and therefore of the two arms 161*a* and 161*b* about the axis 164*a*. The shaft 164 and the motor 167 are mounted on a block 168 that is slideably supported along two guides 169*a* and 169*b* that lie at right angles to the belt 11, in other words vertically, and are fixed to a support 170 that is rigidly coupled to the fixed structure of the machine. Another electric motor 171, for example a step motor, is mounted on the support 170 and is connected, through its output shaft, to a threaded shaft 172 the axis whereof is parallel to the guides 169*a* and 169*b*. The threaded shaft 172 meshes with an internally threaded bush 173 that is rigidly coupled to the block 168, so that the actuation of the motor 171 causes the translatory motion of the block 168 along the guides 169*a* and 169*b*.

In practice, by activating the motor 171, the arms 161*a* and 161*b* are lowered until contact is made, by means of the feet 162, with the foot of the pair of socks 8 arranged on the belt 11. Then, by actuating the motor 167, the arms 161*a* and 161*b* are caused to rotate about the axis 164*a*, along a preset arc that arranges the extension of the foot of the pair of socks substantially at right angles to the advancement direction 3 of the belt 11, i.e., in a position adapted for the subsequent printing step, as will become apparent hereinafter.

Conveniently, in order to achieve the correct positioning of short socks having mutually different body lengths, it is possible to provide, directly upstream of the orientation element 160, means for gripping and shifting the pair of socks, which engage the pair of socks and move them in a direction that is substantially perpendicular to the belt advancement direction according to the length of the sock body. Such means for gripping and shifting the pair of socks can be constituted, for example, by a clamp device of the type already described with reference to the grip and translatory motion means, shown in FIGS. 15 to 17.

Figure 20:
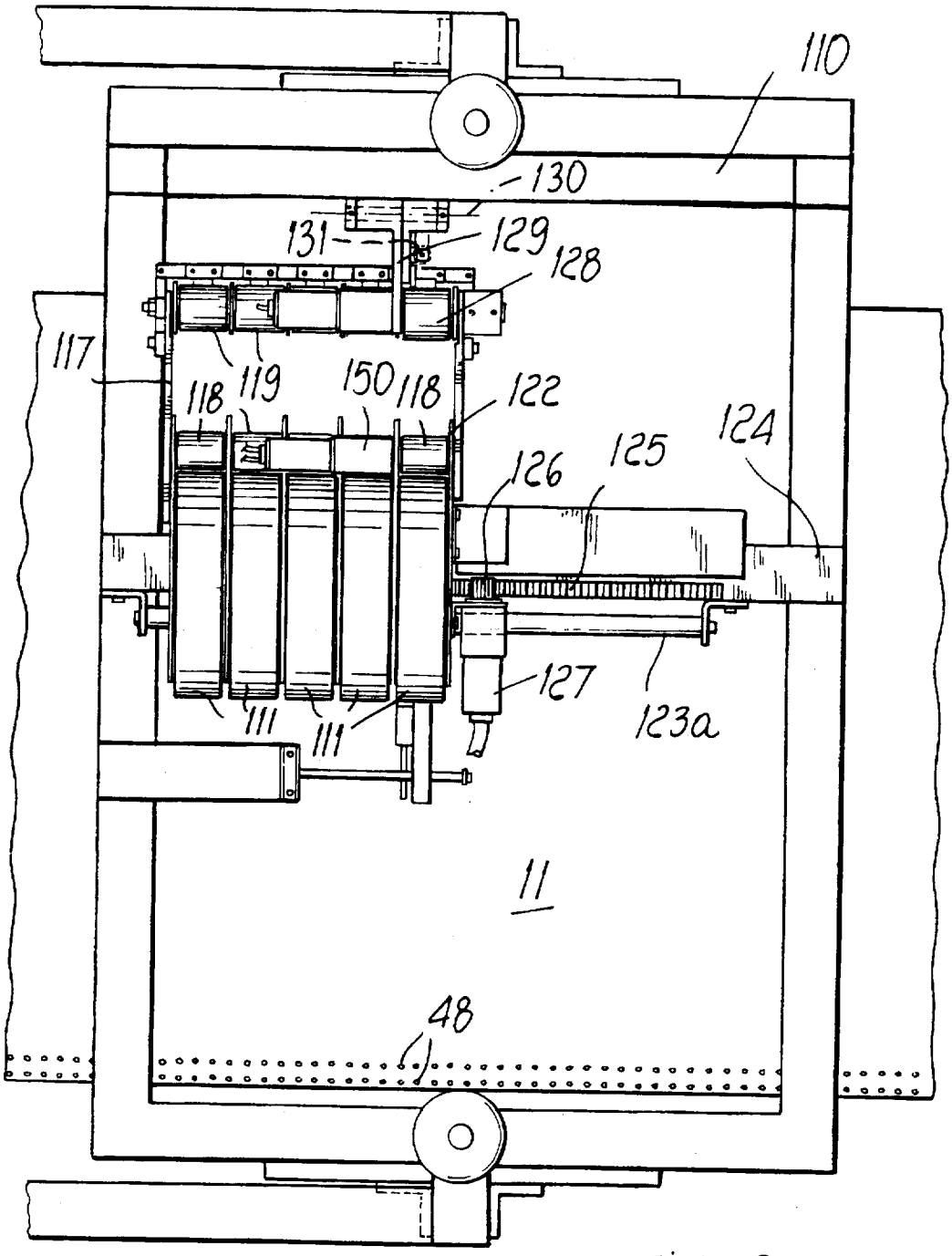
FIG. 20 is a schematic enlarged-scale top plan view of the printing station.
Figure 21:
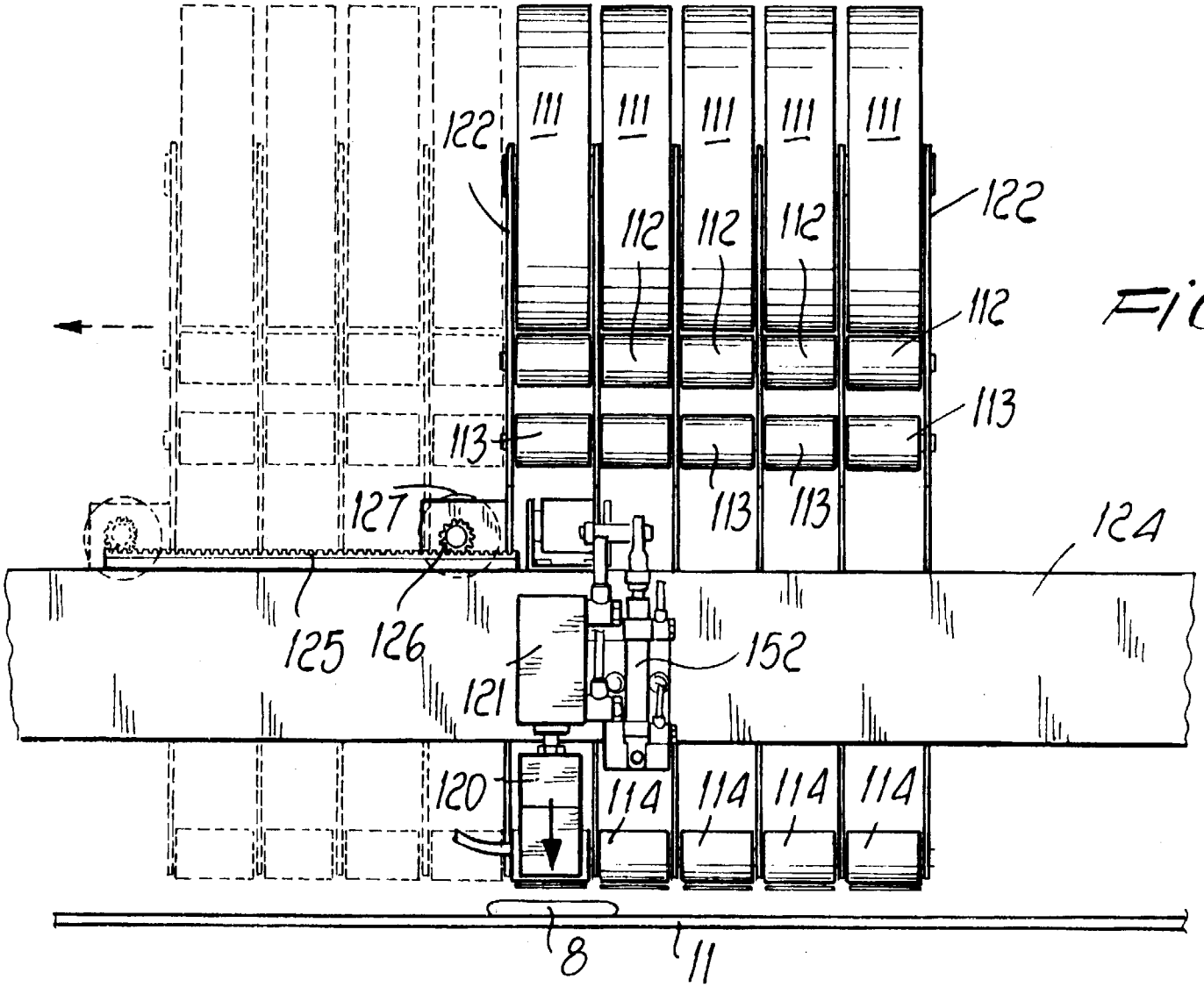
FIG. 21 is an enlarged-scale schematic front elevation view of the printing station.
Figure 22:
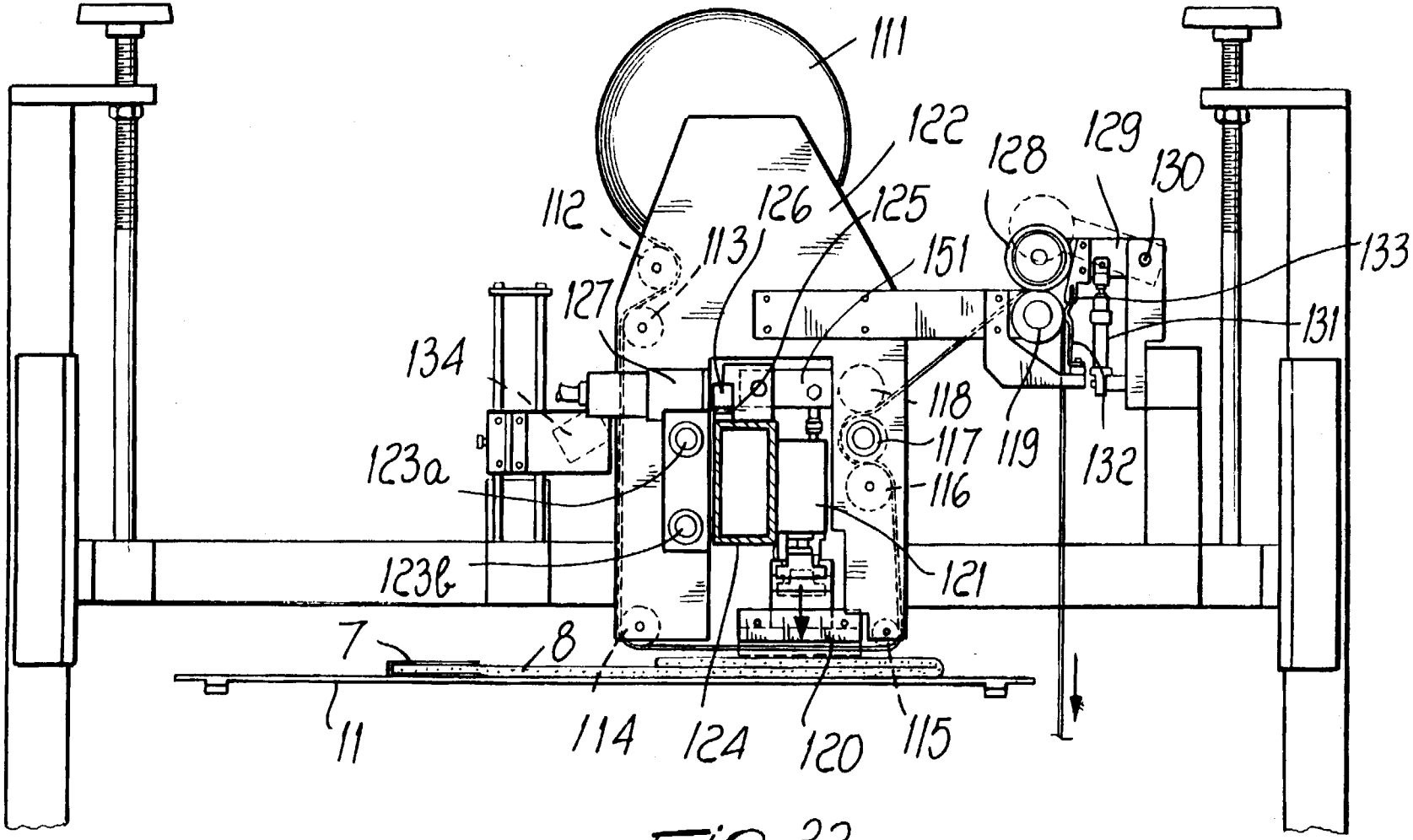
FIG. 22 is a schematic and partially sectional view of the printing station, taken from the unloading station.

The printing station 10, as shown in particular in FIGS. 20 to 22, includes a frame-like structure 110 connected to the movable structure 26 so that it is actuated, together with the movable structure 26, in a reciprocating manner along the advancement direction 3 and is rigidly coupled to the belt 11 in its advancement motion.

The frame-like structure 110 supports a plurality of feeder rollers 111, on each one of which a ribbon is wound; the ribbon supports the decals to be applied to the foot of a sock of the pair of socks arranged on the belt 11. The ribbons of the various feeder rollers 111 carry mutually different decals, bearing for example various sizes or various indications, i.e., a feeder roller for each size or indication is provided.

The feeder rollers 111 are supported by the frame-like structure 110 so as to be rotatable about their respective axes, which are orientated substantially parallel to the advancement direction 3. The frame-like structure 110 also supports a series of guiding rollers, designated by the reference numerals 112 to 117, so as to form a path for the various ribbons originating from the feeder rollers 111 in which a portion of the path, and in particular the portion lying between the rollers 114 and 115 in the illustrated case, faces the upper face of the belt 11 and is parallel thereto.

The frame-like structure 110 also supports a plurality of unloading rollers 119, one for each feeder roller 111, through which the ribbon arriving from the feeder rollers 111 is moved laterally to the belt 11 to be unloaded.

A heated head 120 is also mounted on the frame-like structure 110, faces the belt 11, and is movable on command along a substantially vertical direction by means of a fluid-actuated cylinder 121. The feeder rollers 111, as well as the various rollers 112–117 and the unloading rollers 19, are mounted on an auxiliary structure 122 that is supported by the frame-like structure 110 by a pair of guides 123*a* and 123*b* arranged horizontally and orientated substantially parallel to the advancement direction 3. The auxiliary structure 122 is slideable along the guides 123*a* and 123*b*, and the frame-like structure 110 has an intermediate member 124 that is orientated so that it is parallel to the guides 123*a* and 123*b* and passes through a passage formed in the auxiliary structure 122. A rack 125 is fixed to the member 124, and a pinion 126 meshes with such rack; the pinion 126 is fixed to the output shaft of a step motor 127 that is fixed to the structure 122, so that the actuation of the motor 127 causes the translatory motion of the auxiliary structure 122 along the guides 123*a* and 123*b*.

The heated head 120 is supported by the member 124 and is thus independent of the translatory motion of the auxiliary structure 122 following the actuation of the motor 127. In this manner, by actuating the motor 127 it is possible to arrange below the heated head 120 the portion that lies between the rollers 114 and 115 of one of the ribbons coming from one of the feeder rollers 111. In practice, the motor 127 acts as a selection means, by which the ribbon that bears the intended decal is positioned at the heated head 120. The ribbon coming from the feeder rollers 111 is moved by a motorized roller 128, which is supported by the frame-like structure 110 and faces one of the unloading rollers 119 as a consequence of the translatory motion of the auxiliary structure 122. The roller 128 is supported, so as to be rotatable about its own axis, by an arm 129 that is supported by the frame-like structure 110 so as to be oscillatable about an axis 130 parallel to the axis of the roller 128 and of the unloading rollers 119. A fluid-actuated cylinder 131 acts on the arm 129 and causes, on command, the contact or spacing of the roller 128 with respect to the unloading roller 119 that faces it.

Means for braking the ribbons on the corresponding unloading rollers when the roller 128 is disengaged from the corresponding unloading roller 119 are provided on the auxiliary structure 122, proximate to the unloading rollers 119.

Such braking means are constituted, for each one of the unloading rollers 119, by a spring 132 that presses the ribbon that leaves the unloading roller 119 against the skirt of the corresponding unloading roller, so as to maintain the tension of the ribbon, preventing it from returning towards the feeder roller 111. The arm 129 that supports the roller 128 is provided with a portion 133 which, when the roller 128 is moved closer to one of the rollers 119 by actuating the fluid-actuated cylinder 131, engages the spring 132, separating it from the corresponding unloading roller to allow the outward sliding of the corresponding ribbon.

The outward sliding of the ribbon arriving from the feeder rollers 111 is assisted by an additional motorized roller 118 keyed to the output shaft of a motor 150. The motorized roller 118 is arranged so that its axis lies parallel to the axis of the rollers 112–117 and, together with the motor 150, it is mounted on an arm 151 articulated to the intermediate member 124 of the frame-like structure 10. The stem of the piston of a fluid-actuated cylinder 152 acts on the arm 151, is supported by the intermediate member 24, and causes the oscillation of the arm 151, i.e., the engagement or disengagement of the motorized roller 118 with the roller 117 that is arranged at the roller 118 as a consequence of the translatory motion of the auxiliary structure 122.

The means for controlling the stepwise advancement of the ribbons that move the decals from the feeder rollers 111 to the unloading rollers 119 are provided between the rollers 113 and 114, along the path followed by the ribbon coming from the feeder rollers 111. Such control means can be constituted, for example, by a photocell 134 or by a technically equivalent detector element that detects reference notches, or generic registration marks, applied at uniform intervals that correspond to the advancement step, on the ribbons coming from the feeder rollers 111.

Figures 26, 28:
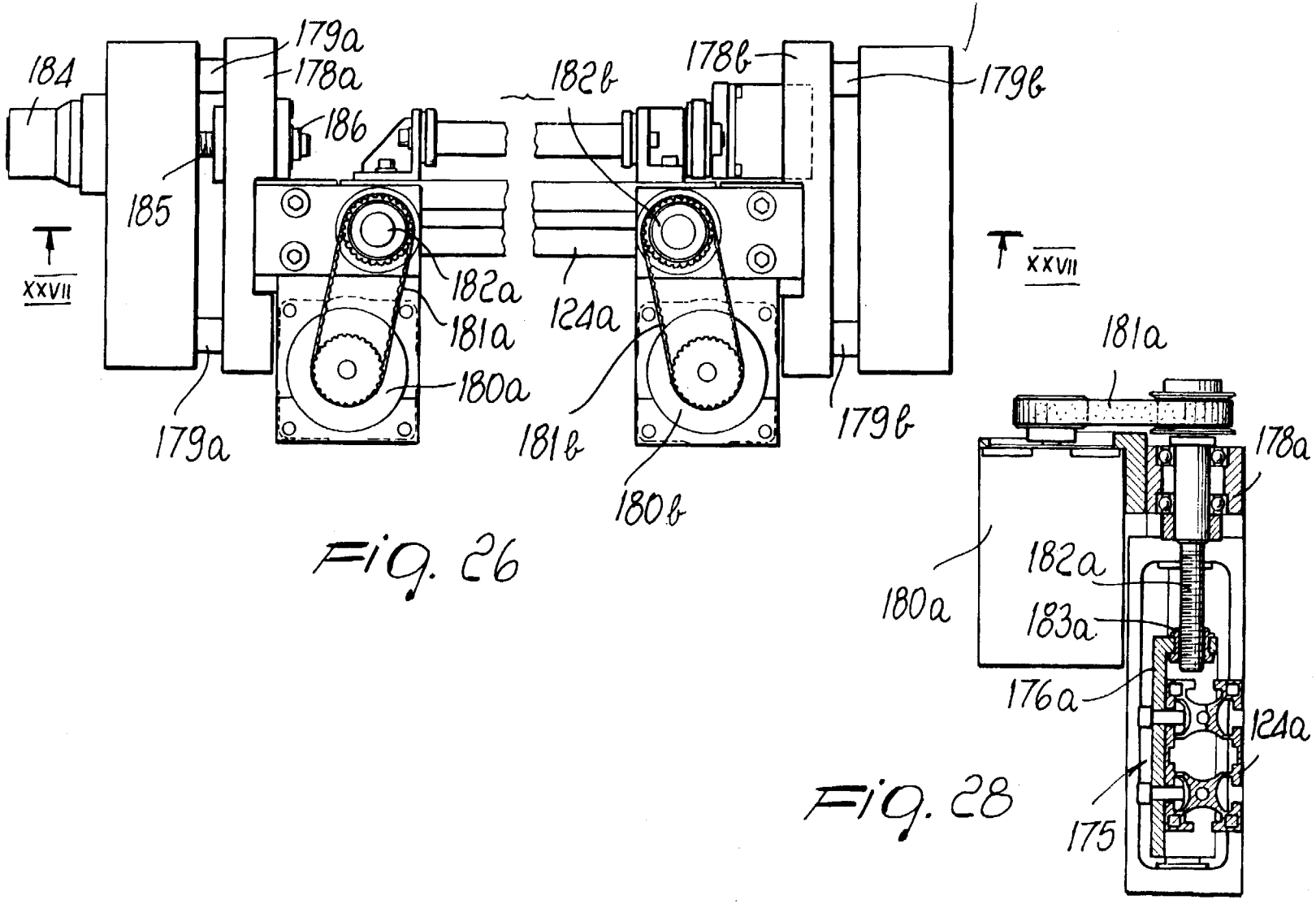
FIG. 26 is a top plan view of a different embodiment of a detail related to the printing station.
FIG. 28 is a sectional view of FIG. 26, taken along the plane XXVIII—XXVIII.
Figure 27:
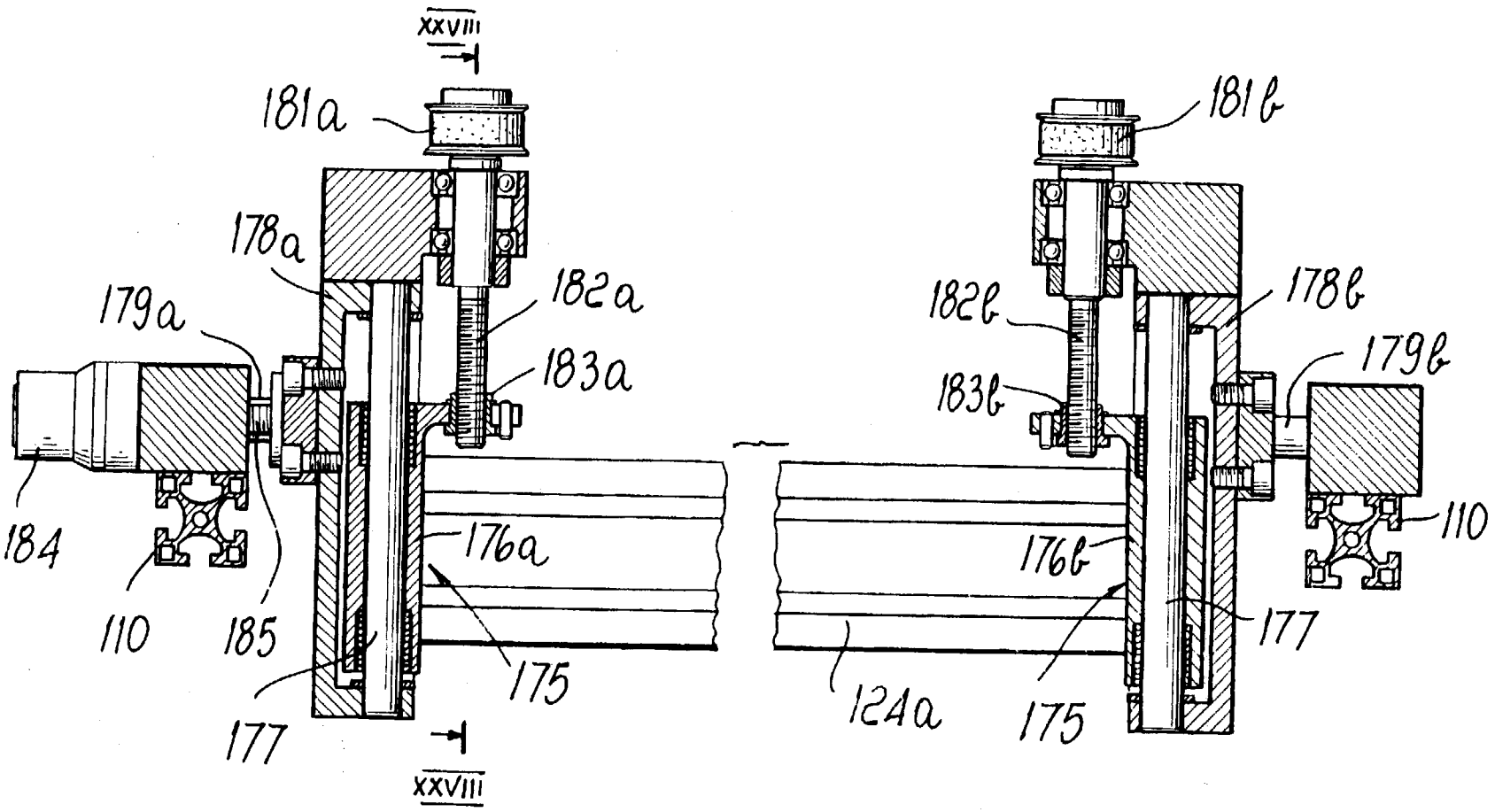
FIG. 27 is a sectional view of FIG. 26, taken along the plane XXVII—XXVII.

FIGS. 26 to 28 are views of another embodiment related to the printing station. According to this different embodiment, there is an intermediate member 124*a* corresponding to the intermediate member 124, i.e., supporting the heated head 120 and the other elements already described with reference to the embodiment shown in FIGS. 20 to 22. The intermediate member 124*a*, instead of being fixed to the frame-like structure 110, is mounted on a supporting structure 175 movable on command with respect to the frame-like structure 110, and thus with respect to the belt 11, along a direction that lies substantially at right angles to the plane of arrangement of the belt 11. Furthermore, the supporting structure 175 is adjustable, with respect to the frame-like structure 110, along a direction substantially parallel to the advancement direction of the belt 11.

More particularly, the intermediate member 124*a* is fixed, by its longitudinal ends, to a pair of blocks 176*a* and 176*b* slideable along vertical guides 177 that are in turn fixed to blocks 178*a* and 178*b* that are supported by the frame-like structure 110 so that they are slideable along guides 179*a* and 179*b* that are parallel to the advancement direction of the belt 11.

Two electric motors 180*a* and 180*b*, for example step motors, are mounted on the blocks 178*a* and 178*b* and are connected through their shafts, for example by means of a toothed-belt transmission 181*a* and 181*b*, to respective threaded secondary shafts 182*a* and 182*b*, that are supported by the blocks 178*a* and 178*b* so that they can rotate about the corresponding vertical axes and couple to threaded bushes 183*a* and 183*b* that are rigidly coupled to the blocks 176*a* and 176*b*. In this manner, the synchronized actuation of the motors 180*a* and 180*b* causes the translatory motion of the intermediate member 124*a*, and therefore of the various elements supported thereby, towards or away from the belt 11 to allow to change the position of the elements according to the thickness of the pair of socks being labeled.

An adjustment knob 184 is fitted to the frame-like structure 110 and is rigidly coupled to a threaded shaft 185, the axis whereof is parallel to the advancement direction 3 of the belt 11. The threaded shaft 185 is coupled to a threaded bush 186 that is rigidly coupled to the block 178*a*. The rotary actuation of the knob 184 produces the movement of the intermediate member 124*a*, and therefore of the elements mounted thereon, in a direction that is substantially parallel to the belt advancement direction, allowing to center the position of such elements with respect to the position of the socks on the belt 11. The adjustment knob 184 can be replaced with an electric motor, for example a step motor.

Figure 13:
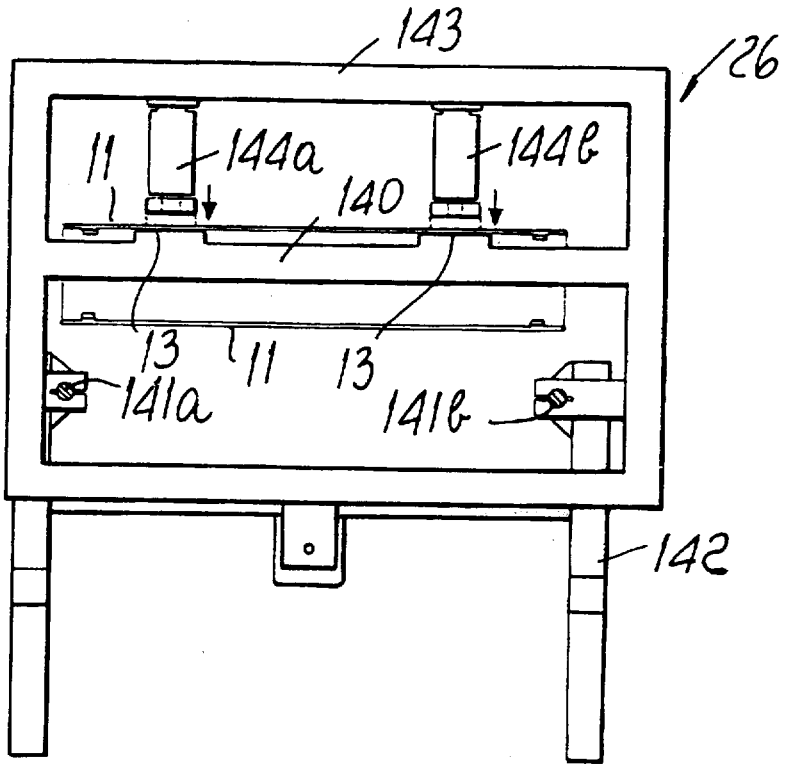
FIG. 13 is a schematic sectional view of FIG. 1, taken along the plane XIII—XIII, with some details omitted for greater clarity.
Figure 14:
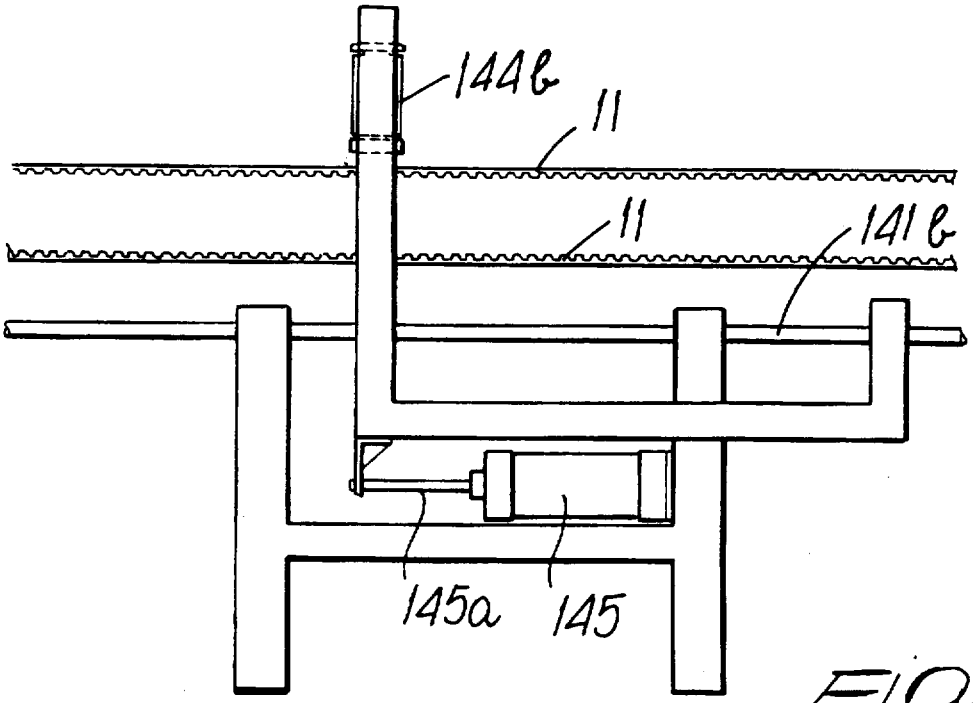
FIG. 14 is a lateral elevation view of the same elements of FIG. 13.

The movable structure 26 is substantially constituted, as shown in particular in FIGS. 13 and 14, by a square-frame structure 139 arranged transversely to the advancement direction 3. The square-frame structure 139 has an intermediate cross-member 140 that forms, in the square-frame structure 139, an upper passage for the upper portion of the belt 11 and a lower passage for the lower portion of the belt 11. The cross-member 140 also forms the supporting surface 13 for the upper portion of the belt 11 by means of a pair of raised portions. The square-frame structure 139 is fixed to two substantially horizontal guiding bars 141*a* and 141*b* that are orientated parallel to the advancement direction 3 and are supported by the fixed structure 142 of machine so as to be slideable longitudinally. The upper cross-member 143 of the square-frame structure 139 is provided with two presser elements 144*a* and 144*b* that lie above the raised portions forming the supporting surface for the upper portion of the belt 11. The presser elements 144*a* and 144*b*, which can be constituted for example by two fluid-actuated cylinders, can be actuated on command so as to clamp the belt 11 between the underlying raised portions of the cross-member 140 and the presser elements 144*a* and 144*b*, thus rigidly coupling the movable structure 26 to the belt 11 in its translatory motion along the direction 3 in the advancement motion.

A fluid-actuated cylinder 145 associated with the fixed structure 142 and acting, with the stem 145*a* of its piston, on the movable structure 26, is provided for the return motion of the movable structure 26. In this manner, the movable structure 26, with the various elements connected thereto, moves rigidly with the belt 11 for a certain extent and is then disengaged from the belt 11 and moved in the opposite direction, so as to retract by one step, where such step substantially corresponds to the distance between two successive pairs of socks fed to the belt 11.

The operation of the machine according to the invention is as follows.

A pair of socks 8 is placed, in each instance, on the positioning region 18 of the fixed table 17. The plate 20, with the return motion of the movable structure 26, is arranged above the pair of socks 8 located on the positioning region 18 of the fixed table 17. At this point, the fluid-actuated cylinder 23 is actuated, lowering the plate 20 until the high-grip layer 20*a* is placed against the pair of socks 8. Meanwhile, the movable arm 30 is actuated so as to extract one of the labels 7 from the magazine 28 and position it on the longitudinal edge 11*a* of the belt 11. Simultaneously, the presser elements 144*a* and 144*b* of the movable structure 26 are engaged with the belt 11 and therefore the movable structure 26 and the elements connected thereto move rigidly with the belt 11. As a result of this connection, the plate 20 moves the pair of socks 8 on the conveyor belt 11, arranging the region of the top of the socks on the portion of the label 7 that rests on the conveyor belt 11. The region of the top of the socks 8 is thus arranged on the portion of the label 7 that rests on the longitudinal edge 11*a* of the belt 11 and on the secondary belts 46, whereas a portion of the label 7 protrudes laterally to the secondary belts 46, as shown in particular in FIGS. 4 and 6. As the belt 11 advances, the pair of socks 8, with the label 7, is moved below the lamina 61, up to the presser element 62, which is actuated as soon as it reaches the pair of socks 8, pressing the pair of socks 8 proximate to their top. At this point, the roller 54 is actuated, folding the portion of the label 7 that protrudes laterally from the longitudinal edge 11*a* and from the secondary belts 46 above the socks in the top region. Also as a consequence of the translatory motion of the belt 11, the socks, together with the label 7 thus folded, are moved below the guide 68, which keeps the label 7 in the folded position so as to straddle the region of the top of the socks.

When the pair of socks arrives at the fixing station 9, and more precisely at the sewing head 74 of the sewing machine 73, the fluid-actuated cylinder 78 is actuated, making the sewing head 74 engage the portion of the label 7 and of the pair of socks 8 that protrudes laterally from the longitudinal edge 11*a* of the belt 11. In this condition, the footing 77 of the sewing machine is connected to the movable structure 26 that is engaged with the belt 11. In this manner, the sewing head 74 fixes the label to the pair of socks, moving rigidly with the belt 11.

When the pair of socks 8 leaves the fixing station 9, it is picked up by the clamp 90 and moved transversely to the advancement direction 3, away from the edge 11*a*.

If short socks are labelled, the orientation means that place the foot extension of the socks along an axis lying substantially at right angles to the advancement direction 3 are actuated first.

The pair of socks thus arrives at the printing station 10, where the ribbon with the decals of the feeder roller 111 corresponding to the decal to be applied to the foot of one of the socks of the pair has been moved beforehand, by means of the translatory motion of the auxiliary structure 122, at the heated head 120. At this point, the fluid-actuated cylinder 121 is actuated and presses the heated head 120 against the ribbon and therefore presses the ribbon against the foot of the sock to be printed. During this operation, the movable structure 26 is rigidly coupled to the belt 11 in its translatory motion along the direction 3.

Once printing has been performed, the heated head 20 is raised above the socks and the motorized roller 128 is actuated, causing the advancement, by one step, of the ribbon used for printing, unloading a corresponding ribbon portion and arranging a new decal at the heated head 120.

At this point, the movable structure 26 is disengaged from the belt 11 and is moved backwards by one step to position the elements of the various stations that are connected to the movable structure at a new pair of socks. The pair of socks thus labeled and printed is unloaded at the end of the belt 11 that constitutes the unloading station 5.

The operating cycle thus described is repeated, step by step, for other pairs of socks fed to the belt 11.

In practice, it has been observed that the machine according to the invention fully achieves the intended aim, since it is capable of labeling and printing socks in a fully automatic manner and at a high hourly production rate, requiring a reduced use of labor.

The machine thus conceived is susceptible of numerous modifications and variations, all of which are within the scope of the inventive concept; all the details may furthermore be replaced with other technically equivalent elements.

In practice, the materials employed, as well as the dimensions, may be any according to the requirements and the state of the art.

What is claimed is:

1. Automatic sock labeling machine comprising a conveyor element extending along a path from a station for loading socks on said conveyor element to a station for unloading labeled socks from said conveyor element, said conveyor element being movable with a translatory motion in an advancement direction extending along the path from said station for loading socks to said station for unloading labeled socks, the sock labeling machine further comprising, positioned along the path of said conveyor element, a station for positioning a label astride the top of a pair of mutually superimposed socks, said conveyor element comprising a belt for supporting socks, said station for positioning a label astride the top of a pair of mutually superimposed socks comprising means for depositing a label on said belt such that a supported portion of said label is supported on said belt and a protruding portion of said label protrudes from a longitudinal edge of said belt, said pair of mutually superimposed socks being loadable at said station for loading socks such that a lower side of the top of said pair of mutually superimposed socks rests upon said supported portion of said label, said station for positioning further comprising means for engaging said protruding portion of said label and for folding said protruding portion over the top of said pair of mutually superimposed socks which have been loaded upon said supported portion of said label such that said protruding portion assumes a folded position adjacent an upper side of the top of said pair of mutually superimposed socks.

2. Machine according to claim 1, wherein a station for printing markings at the foot of one sock of the pair of mutually superimposed socks is arranged along the path of said conveyor element.

3. Machine according to claim 1, wherein said belt surrounds at least one pair of rollers having mutually parallel and horizontal axes, said belt resting, for part of its length, on a substantially horizontal supporting surface and forming a supporting surface for the socks with its upper face.

4. Machine according to claim 1, wherein said loading station comprises a fixed table for positioning a plurality of pairs of mutually superimposed socks, said table being arranged at the beginning of said belt, and feeder means that are movable in a reciprocating manner along said advancement direction and can engage of socks that is waiting on said fixed table for the passage of said pair of socks onto said belt so that the top of the socks is arranged proximate to said longitudinal edge of said belt.

5. Machine according to claim 1, wherein said positioning station further comprises a magazine adapted to support a plurality of labels, said means for depositing comprising means for sequentially removing one of said labels from said magazine to deposit it on said belt so that the respective protruding portion of said label protrudes from said longitudinal edge of the belt, and said positioning station further comprising means for retaining the label on said belt after depositing it on said belt.

6. Machine according to claim 5, wherein said belt has a plurality of perforations at said longitudinal edge, and said means for retaining the label comprise a channel that is open in an upward region and faces the lower face of said belt at said perforations, said channel being connected to suction means for the adhesion of said label to said belt at said perforations.

7. Machine according to claim 1, wherein said conveyor element comprises auxiliary supporting means that move rigidly with said belt and are laterally adjacent to said longitudinal edge of the belt to support said protruding portion of the label and the top of said pair of mutually superimposed socks rested on said label; said auxiliary supporting means extending from said depositing means of the positioning station up to a station for fixing said label to the pair of mutually superimposed socks, which is located downstream of said positioning station along the advancement direction of said belt.

8. Machine according to claim 7, wherein said auxiliary supporting means comprise secondary belts that are adjacent and parallel to said longitudinal edge of the belt.

9. Machine according to claim 5, wherein said removal means comprise a movable arm provided with suckers that are connectable to suction means for their engagement with one of the labels located in said magazine and for their disengagement from the label after resting the label on said belt.

10. Machine according to claim 1, wherein said folding means comprise a roller that is movable on command from an inactive position, in which the roller is arranged below the plane of arrangement of said belt and is spaced laterally therefrom, to an active position, in which said roller is arranged above the plane of arrangement of said belt and is moved transversely with respect to said belt and towards said belt with respect to said inactive position.

11. Machine according to claim 7, further comprising means for pressing the top region of the socks on said auxiliary supporting means, said pressing means being arranged between said removal means and said folding means.

12. Machine according to claim 11, wherein said pressing means comprise a lamina that faces said belt in an upward region and forms, together with said belt, a passage for the portion of the socks that rests on said label and for the underlying portion of the label, the distance between said lamina and said belt gradually decreasing concordantly with the advancement direction of said belt, said lamina being elastically flexible.

13. Machine according to claim 12, wherein said pressing means comprise a presser element arranged at said folding means, said presser element being arranged above said belt proximate to said longitudinal edge and being movable towards or away from said belt to affect the regions of the socks located laterally to the region adapted to receive the portion of the label folded by said folding means.

14. Machine according to claim 11, wherein said pressing means and said folding means are movable in a reciprocating manner along said advancement direction, said pressing means and said folding means being rigidly coupled to said belt in their advancement motion.

15. Machine according to claim 7, wherein means for keeping the fold given to said label are provided between said folding means and said fixing station.

16. Machine according to claim 15, wherein said fold keeping means comprise a guide that faces said belt in an upward region and forms, together with said belt, a passage for the region of said socks that is affected by said label.

17. Machine according to claim 7, wherein said fixing station comprises a sewing machine that is laterally adjacent to said longitudinal edge of the belt and is movable along a direction that lies transversely to the extension of said belt to engage, with a sewing head thereof, the portion of the label that is folded astride the top of the socks and protrudes laterally from said longitudinal edge of the belt.

18. Machine according to claim 17, wherein said sewing machine is mounted on a footing that is movable in a reciprocating manner along said advancement direction, said footing being rigidly coupled to said belt in its advancement direction.

19. Machine according to claim 17, wherein means for detecting whether the label has been fixed correctly are arranged directly downstream of said sewing machine along the advancement direction of said belt.

20. Machine according to claim 7, further comprising a station for printing markings at the foot of one sock of the pair of mutually superimposed socks, said fixing station being arranged along the path of said conveyor element, and wherein said printing station is arranged downstream of said fixing station along the advancement direction of said belt.

21. Machine according to claim 20, wherein means for gripping and causing the translatory motion of the pair of socks along a direction that lies transversely to the advancement direction of said belt are provided between said fixing station and said printing station.

22. Machine according to claim 21, wherein said grip and translatory motion means comprise a clamp that can engage the pair of socks that leaves said fixing station, said clamp being movable transversely to said advancement direction and being mounted on a supporting structure actuatable with a reciprocating motion along said advancement direction and rigidly coupleable to said belt in its advancement motion.

23. Machine according to claim 2, wherein means for orientating an extension of the foot of the pair of socks along an axis that is substantially perpendicular to said advancement direction are provided between said fixing station and said printing station.

24. Machine according to claim 23, wherein said means for orientating the extension of the foot of the socks comprise an orientation element that faces said belt and is movable toward or away from said belt to engage the foot of the socks, said orientation element being rotatable on command, over an arc of preset breadth, about an axis that is substantially perpendicular to the plane of arrangement of said belt in order to vary the orientation of the foot of the socks with respect to said advancement direction.

25. Machine according to claim 24, wherein means for gripping and shifting the socks in a direction that is substantially perpendicular to said advancement direction are arranged upstream of said orientation element along the advancement direction of said belt.

26. Machine according to claim 2, wherein said printing station comprises: at least one roller for feeding a ribbon bearing decals to be applied to the socks; means for positioning a portion of said ribbon bearing one of said decals above the foot of a sock of the pair of socks arranged on said belt; and a heated head that is actuatable on command to press said belt portion against the foot of a sock of the underlying pair of socks.

27. Machine according to claim 2, wherein said printing station comprises: a plurality of rollers for feeding ribbons that bear decals to be applied to the socks; means for positioning a portion of said ribbons on a plane lying substantially parallel to said sock supporting belt and facing it; a heated head arranged above the foot of the sock adapted to receive the decal carried by one of said ribbons; and selector means that arrange said portion of one of said ribbons, bearing the decal to be applied, between said heated head and the underlying sock to be printed.

28. Machine according to claim 27, comprising rollers for unloading said ribbons that are actuatable for the intermittent advancement of the used ribbon and for the gradual spacing of the ribbon, depleted of its decals, from said printing station.

29. Machine according to claim 28, wherein said feeder rollers, said heated head, and said unloading rollers are mounted on a movable structure that is actuatable in a reciprocating manner along said advancement direction, said movable structure, in its advancement motion, being rigidly associated with said belt in its translatory motion along said advancement direction.

30. Machine according to claim 29, wherein said feeder rollers and said unloading rollers are mounted on an auxiliary structure and are arranged so that their axes lie parallel to said advancement direction, said auxiliary structure being movable on command with respect to said movable structure along a direction that is parallel to said advancement direction to position a portion of one of said ribbons below said heated head.

31. Machine according to claim 28, further comprising means for braking the ribbons on the corresponding unloading rollers.

32. Machine according to claim 28, further comprising means for controlling the stepwise advancement of said ribbons bearing the decals from said feeder rollers to said unloading rollers.

33. Machine according to claim 29, wherein said feeder rollers, said heated head, and said unloading rollers are mounted on a supporting structure that is in turn mounted on said movable structure, said supporting structure being movable on command along a direction that is substantially perpendicular to the plane of arrangement of said belt in order to vary the distance of said heated head and of said ribbons from said belt.

34. Machine according to claim 33, further comprising means for adjusting the position of said supporting structure with respect to said structure that can move parallel to said advancement direction.

35. Automatic shock labeling machine comprising a conveyor element extending along a path from a station for loading socks on said conveyor element to a station for unloading labeled socks from said conveyor element, said conveyor element being movable with a translatory motion in an advancement direction extending along the path from said station for loading socks to said station for unloading labeled socks, the sock labeling machine further comprising, positioned along the path of said conveyor element, a station for positioning a label astride the top of a pair of mutually superimposed socks, said conveyor element comprising a belt for supporting socks, said station for positioning a label astride the top of a pair of mutually superimposed socks comprising a device for depositing a label on said belt such that a supported portion of said label is supported on said belt and a protruding portion of said label protrudes from a longitudinal edge of said belt, said pair of mutually superimposed socks being loadable at said station for loading socks such that a lower side of the top of said pair of mutually superimposed socks rests upon said supported portion of said label, said station for positioning further comprising a device for engaging said protruding portion of said label and for folding said protruding portion over the top of said pair of mutually superimposed socks which have been loaded upon said supported portion of said label such that said protruding portion assumes a folded position adjacent an upper side of the top of said pair of mutually superimposed socks.

* * * * *